US011129762B2

(12) United States Patent
Latney et al.

(10) Patent No.: US 11,129,762 B2
(45) Date of Patent: Sep. 28, 2021

(54) WHEELCHAIR AND BED COMBINATION AND METHOD OF USE

(71) Applicant: AWB Group, LLC, Bowie, MD (US)

(72) Inventors: Arthur Ray Latney, Bowie, MD (US); John Allen McMennamy, Rydal, GA (US)

(73) Assignee: AWB Group, LLC, Bowie, MD (US)

( * ) Notice: Subject to any disclaimer, the term of this patent is extended or adjusted under 35 U.S.C. 154(b) by 147 days.

(21) Appl. No.: 16/528,884

(22) Filed: Aug. 1, 2019

(65) Prior Publication Data

US 2020/0038272 A1 Feb. 6, 2020

Related U.S. Application Data

(60) Provisional application No. 62/713,635, filed on Aug. 2, 2018.

(51) Int. Cl.

| | |
|---|---|
| ***A61G 7/053*** | (2006.01) |
| ***A61G 5/00*** | (2006.01) |
| ***A61G 5/12*** | (2006.01) |
| ***A61G 7/012*** | (2006.01) |
| ***A61G 5/10*** | (2006.01) |

(52) U.S. Cl.

CPC ..... *A61G 7/053* (2013.01); *A61G 5/006* (2013.01); *A61G 5/1059* (2013.01); *A61G 5/1067* (2013.01); *A61G 5/125* (2016.11); *A61G 7/012* (2013.01)

(58) Field of Classification Search

CPC ..... A61G 7/053; A61G 5/006; A61G 5/1067; A61G 5/125; A61G 5/1059; A61G 7/012

See application file for complete search history.

(56) References Cited

U.S. PATENT DOCUMENTS

| | | | | |
|---|---|---|---|---|
| 2,607,929 | A * | 8/1952 | Balluff | A61G 7/10 5/618 |
| 3,138,805 | A * | 6/1964 | Piazza | A61G 7/00 5/618 |
| 4,240,169 | A * | 12/1980 | Roos | A61G 3/06 297/DIG. 4 |
| 5,134,737 | A * | 8/1992 | Wyman | A61G 5/00 5/185 |
| 5,513,406 | A * | 5/1996 | Foster | A61G 7/00 177/1 |
| 6,374,436 | B1 * | 4/2002 | Foster | A61G 7/0015 5/624 |
| 8,157,287 | B1 * | 4/2012 | Cleveland | A61G 5/006 280/648 |
| 8,677,524 | B2 * | 3/2014 | Kume | A61G 5/04 5/86.1 |
| 9,375,376 | B2 | 6/2016 | Latney | |
| 2001/0029629 | A1 * | 10/2001 | Tsuji | A61G 5/128 5/618 |
| 2006/0085919 | A1 * | 4/2006 | Kramer | A47C 27/083 5/713 |

(Continued)

*Primary Examiner* — Eric J Kurilla

(74) *Attorney, Agent, or Firm* — Clark & Brody LP

(57) ABSTRACT

A wheelchair and bed combination includes a wheelchair whose seat forms a part of the bed when the wheelchair is attached to a frame of the bed. The wheelchair can be disengaged from the bed using the bed raising and lowering mechanism so that a patient in the bed can be easily moved from the bed with a minimum of patient lifting and movement.

12 Claims, 28 Drawing Sheets

(56) References Cited

U.S. PATENT DOCUMENTS

| | | | | |
|---|---|---|---|---|
| 2016/0128882 | A1* | 5/2016 | Tsukada | A47C 7/54 5/613 |
| 2016/0128885 | A1* | 5/2016 | Latney | A61G 5/128 5/613 |

* cited by examiner

WHEELCHAIR AND BED COMBINATION AND METHOD OF USE

This application claims priority benefits from U.S. Provisional Application No. 62/713,635 filed on Aug. 2, 2018, entitled "Wheelchair and bed Combination and Method of Use". The '635 application is hereby incorporated by reference herein in its entirety.

FIELD OF THE INVENTION

The present invention relates to a wheelchair and bed combination and method of use and particularly to a combination that uses the bed raising and lowering mechanism to assist in attaching and releasing the wheelchair from the combination.

BACKGROUND ART

In the field of caring for sick or otherwise impaired patients, one common problem encountered by caregivers is moving a patient from a bed to a wheelchair. This often requires lifting of the patient by the caregiver and the caregiver can sustain injuries from the handing of the patient.

As such, a need exists to make it easier for caregivers to transfer patients from a bed to a wheelchair when required. The present invention responds to this need with an improved wheelchair and bed combination.

SUMMARY OF THE INVENTION

One object of the invention is provide a wheelchair and bed combination, wherein a patient in bed does not have to be lifted from the bed to a wheelchair. The wheelchair and bed combination allows the patient to be minimally moved to the wheelchair portion of the combination and moved to a desired location using the wheelchair. The patient is easily transferred back to the bed from the wheelchair, again with a minimum of manipulation and One embodiment of the wheelchair and bed combination comprises a bed assembly; and a wheel chair. The bed assembly includes a bed frame, a mattress, the mattress and bed frame including a slot therein, and means for moving the bed at least up and down and between at least a raised position and a lowered position.

The wheelchair includes a wheelchair frame, wheels, an arm rest assembly having a back portion and two side portions, a wheel chair seat, and an arm rest supporting mechanism. The wheelchair frame is removably attachable to the bed frame, wherein the wheelchair frame is attached to the bed frame using a first locking mechanism when the bed frame is in a raised position with the wheelchair seat generally aligned with the mattress to form a bed surface for a patient lying on the bed, and releasable from the bed frame using the locking mechanism and removable from the slot when the bed is in a lowered position with the wheelchair frame in contact with ground so as to allow a patient to travel in the wheelchair.

The arm rest assembly is movable with respect to the wheelchair frame, the arm rest assembly being in a lowered position with respect to the wheelchair seat when the bed frame is in the raised position and the wheelchair seat is generally aligned with the mattress, the arm rest assembly supported by the bed frame when in the lowered position, the arm rest assembly being in a raised position with respect to the wheelchair seat with the wheelchair frame released from the bed frame using the first locking mechanism, the arm rest supporting mechanism engaging a portion of the arm rest assembly to maintain the arm rest assembly in the raised position for use by a patient when the wheelchair is removed from the slot.

The wheelchair and bed combination can include an additional locking mechanism, the additional locking mechanism part of the arm rest supporting mechanism, wherein when the arm rest supporting mechanism is engaged with the arm rest assembly to maintain the arm rest assembly in the raised position, the additional locking mechanism is disengaged from the wheelchair frame to allow the wheelchair to be removed from the slot.

The arm rest assembly can further include a back extension movably attached to the arm rest assembly, the back extension movable between a stored position when the wheelchair is in the slot and a raised position when the wheelchair is removed from the slot. Further yet, the arm rest assembly can include a pair of movable arm rests, each movable arm rest movable between a stored position when the wheelchair is in the slot and a raised position when the wheelchair is removed from the slot.

While the first locking mechanism can be any type to attain the locking function for the wheelchair, the first locking mechanism can use movable hooks on the bed frame to removably attach the wheelchair frame to the bed frame.

Besides the combination of the wheelchair and the bed, the invention also includes just the wheelchair for use with a hospital bed.

The invention also embodies a method of moving a patient in a bed to a wheelchair that is part of the bed. The method includes the steps of providing the wheelchair and bed combination and starting with the bed frame in a raised position and the wheelchair attached to the bed frame. The bed frame is then lowered to place the wheelchair on ground. At least a portion of the wheelchair frame is detached from the bed frame. The bed frame is then raised so as to raise the arm rest assembly of the wheelchair to form a space of the wheelchair. The arm rest assembly is then secured in a raised position to the wheelchair; and the wheelchair is removed from the slot in the bed frame to allow the wheelchair to be moved.

The steps listed above to remove the wheelchair from the bed are reversed so that the wheelchair is made part of the bed for use by a patient. That is, the bed frame is in the raised position to receive the wheelchair. The arm rest assembly is then released and the bed frame is lowered so that the seat aligns with the top of the bed mattress and the arm rest assembly is lowered. The wheelchair is then locked to the bed frame and the bed frame is raised so that the wheelchair seat is now part of the bed mattress and the patient can use the bed again.

So, a patient in the bed can be easily moved to the wheelchair seat and the patient can then be wheeled from the bed once the wheelchair is released from the bed frame. When the patient needs to return to the bed, the wheelchair with the patient in it is put back into the slot of the bed

BRIEF DESCRIPTION OF THE DRAWINGS

Most of the drawings of the wheelchair and bed combination are illustrated without the cushions to show more detail and some drawings are provided that show the cushions.

FIG. 1*e* is a view of the bed in the raised position but the wheelchair remaining in its lowered position, with a first mechanism released so that the arm rest assembly of the wheelchair is not attached to the bed assembly and the arm rest assembly is raised with the raising of the bed.

DETAILED DESCRIPTION OF THE INVENTION

One embodiment to the wheelchair bed assembly is shown in FIGS. 1*a* to 8*e*. It should be understood that this embodiment is only one way to accomplish the functionality of the wheelchair bed assembly and other ways to attain the same function can be used as is described in more detail below.

Figure 1A:
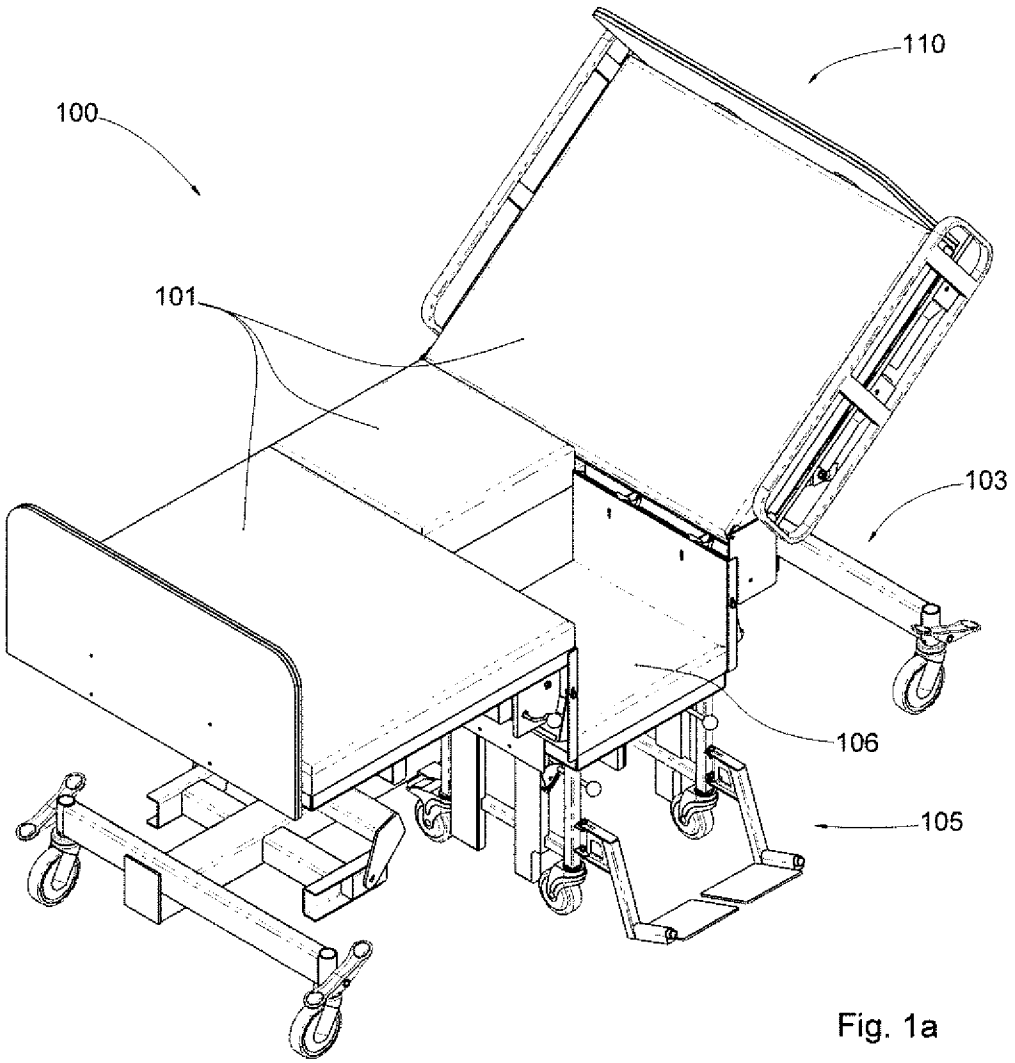
FIG. 1*a* is a perspective view of the wheelchair and bed combination with the wheelchair in the lowered position but still attached to the bed.
Figure 1B:
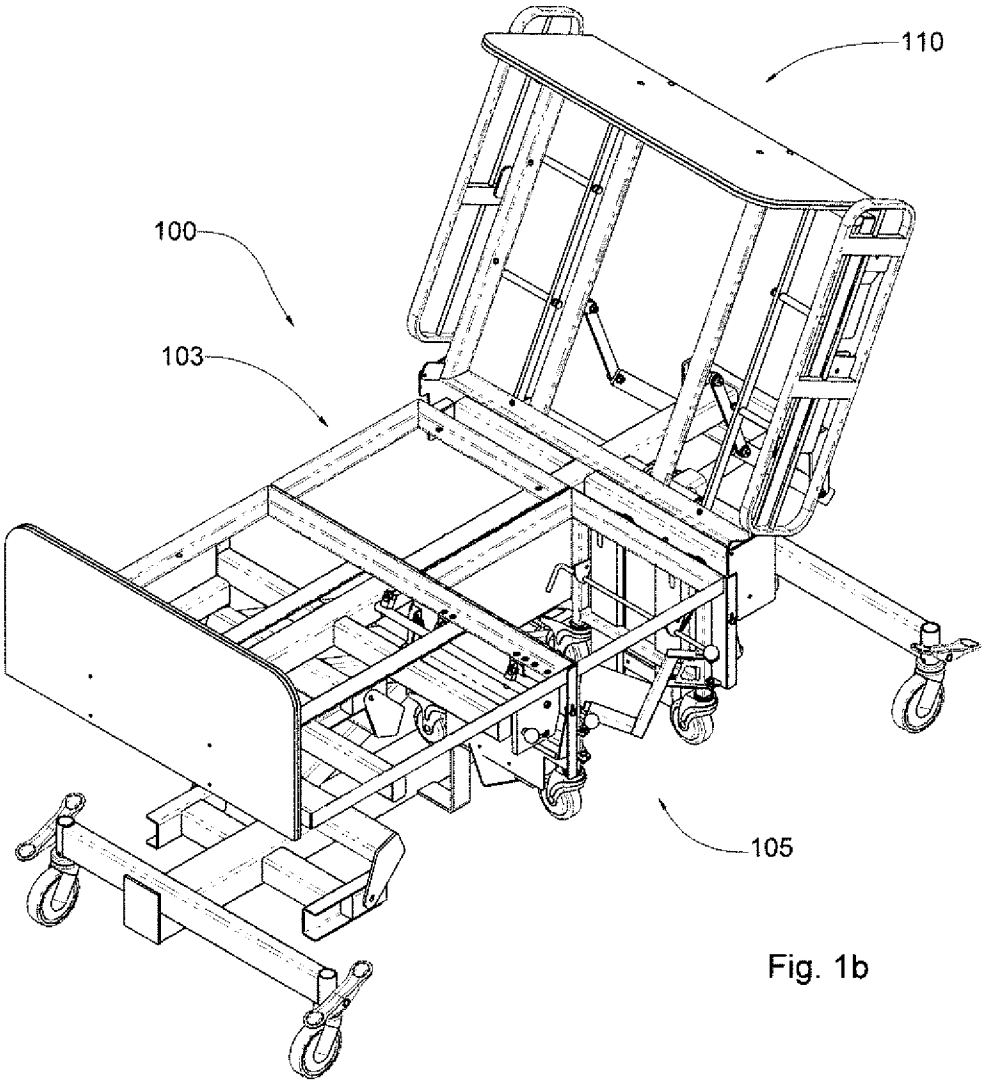
FIG. 1*b* is a front perspective view of one embodiment of the inventive wheelchair and bed combination in a raised position with the wheelchair attached without the cushions to show more detail.
Figure 1C:
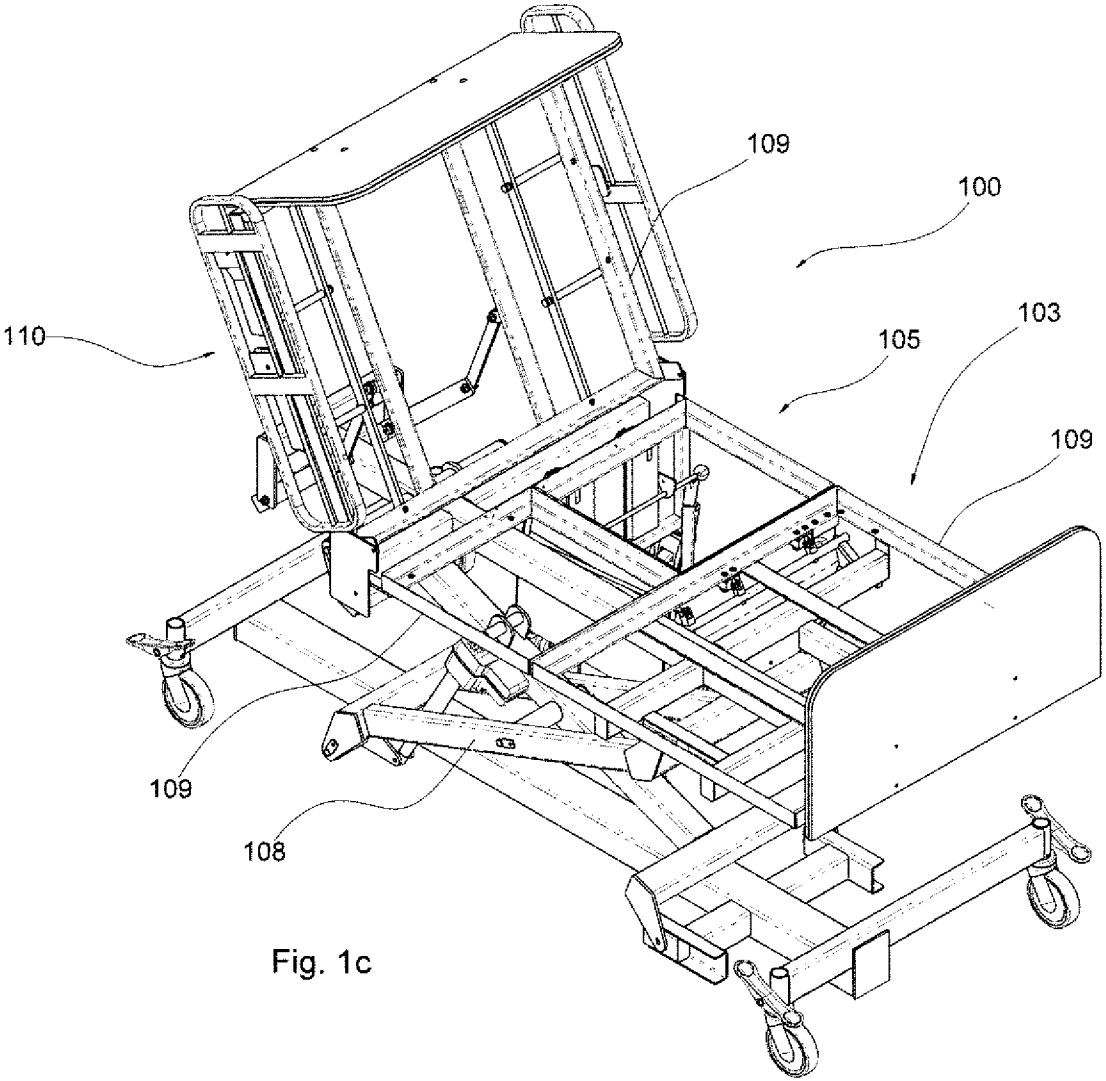
FIG. 1*e* is a rear perspective view of one embodiment of the inventive wheelchair and bed combination in a raised position with the wheelchair attached without the cushions to show more detail.
FIG. 1*d* is a perspective view of the wheelchair and bed combination bed in the lowered position with the wheelchair attached.
FIG. 1*f* is a view of the bed without the wheelchair, thus showing the slot sized to receive the wheelchair.

Referring to FIGS. 1*a*-1*f*, the wheelchair and bed combination is designated by the reference numeral 100 and shown in FIG. 1*a*. The combination 100 includes a mattress 101 that rests on a bed frame 103, a wheelchair 105, and a wheelchair seat 106 (FIG. 1*a*). The wheelchair 105 is disposed in a slot 107 (FIG. 10 in the bed frame 103. The bed frame 103 is shown with a scissors mechanism 108 (FIG. 1*c*) for raising and lowering a mattress support 109 part of the bed frame. It should be understood that any kind of mechanism can be used to raise and lower the bed mattress support. The mattress support 109 can also have features where a head and/or foot part of the mattress support can be movable up and down so that a patient on the mattress can have their head or feet elevated. A movable head support 110 is illustrated in FIG. 1*c*.

The wheelchair 105 detached from the bed frame 103 is shown in FIGS. 2*a*-3*b*. The wheelchair has a wheelchair frame 111, an arm rest assembly 115, wheels 117, and foot rest assembly 119. The foot rest assembly 119 is a conventional wheelchair type and no further description of it is required.

Still referring to FIGS. 2*a*-3*b*, the arm rest assembly 115 includes an arm rest/back part 121, which has a back portion 123 and two side portions 125. In this embodiment, the arm rest/back part 121 is unitary as part of moving it when releasing and attaching the wheelchair to the bed. However, the back portion 123 and side portions 125 could be made separate. With separate parts, additional features would be needed to attach the separate parts to the bed and allow for their release from the bed.

Figure 2A:
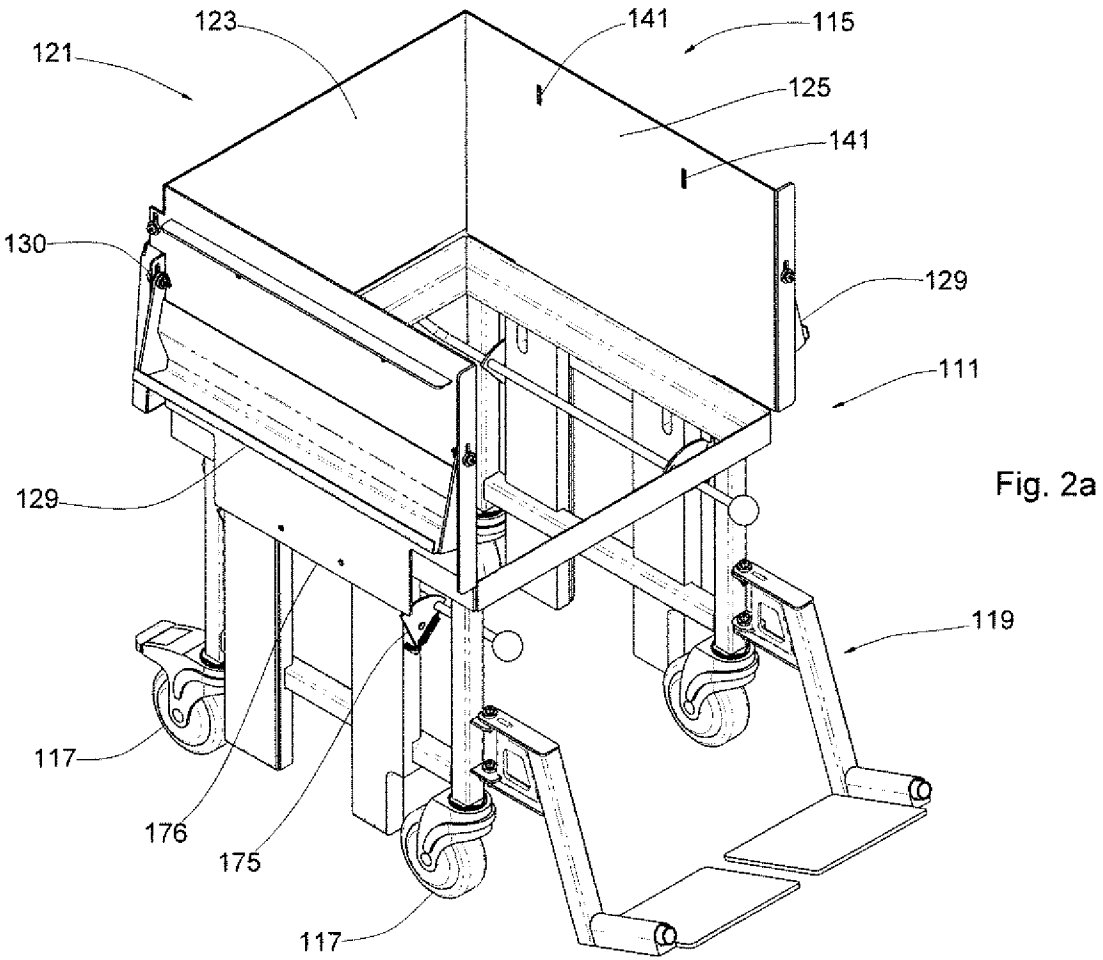
FIG. 2*a* is a perspective view of the wheelchair removed from the bed after the additional locking mechanism is activated to release the wheelchair from the bed and lock the arm rest assembly in its raised position.
Figure 2B:
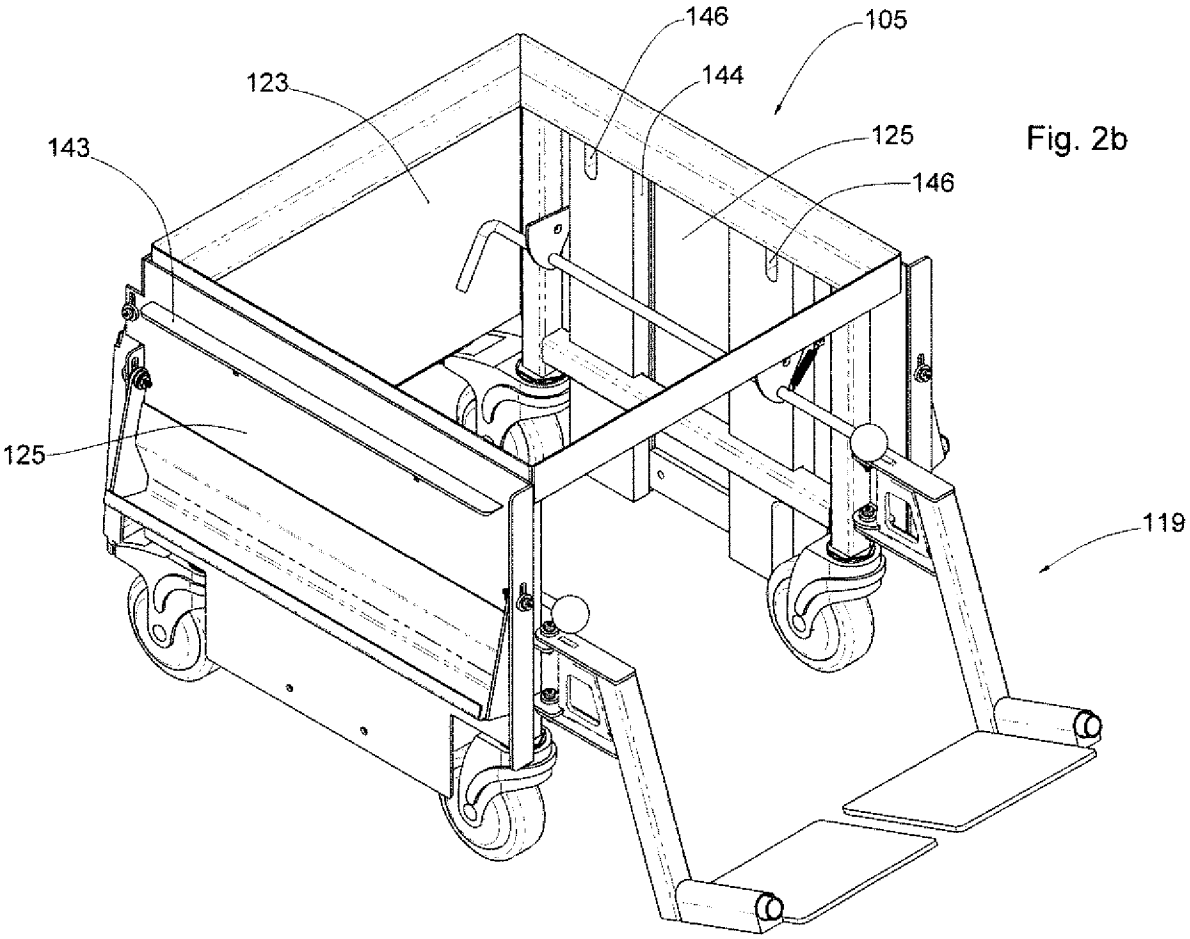
FIG. 2*b* is a perspective view of the wheelchair with the arm rest assembly in its lowered position, which is the configuration of the wheelchair when attached to the bed to form a bed for a patient or the configuration before the bed frame is raised to lift the arm rest assembly to form a working wheelchair.
Figure 3A:
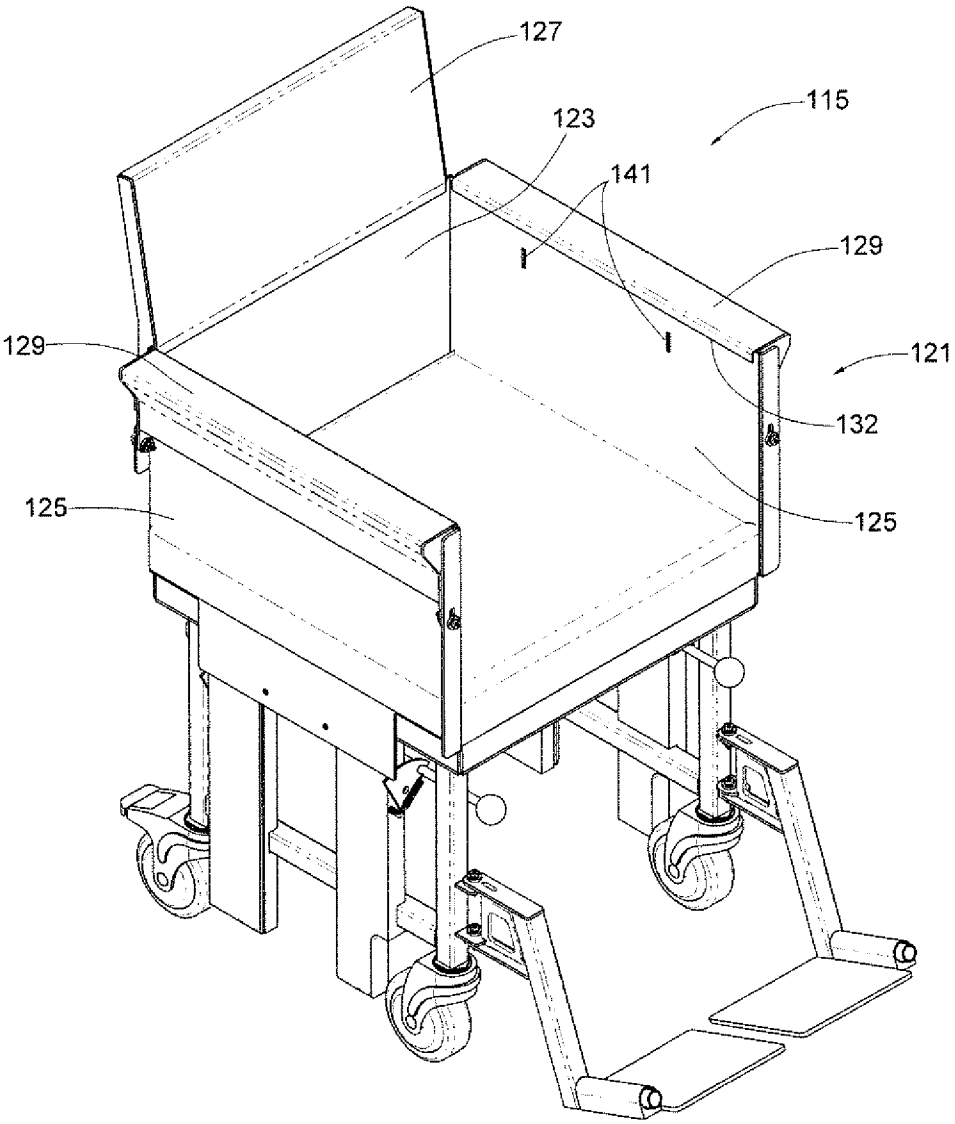
FIG. 3*a* shows the wheelchair with the arm rests and back support in the raised position.
Figure 3B:
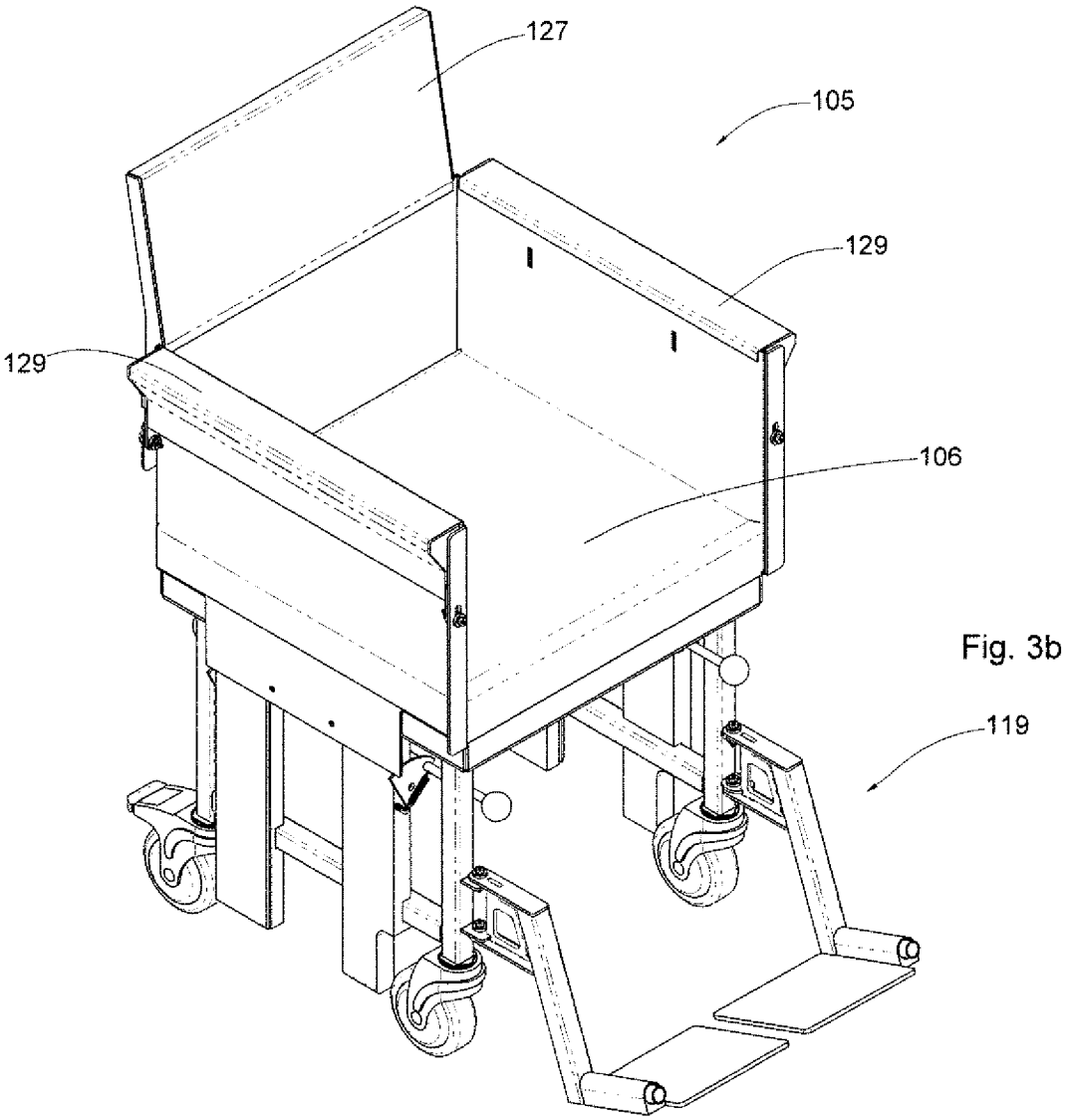
FIG. 3*b* shows the wheelchair of FIG. 3*a* with its seat cushion.

The arm rest assembly 115 also have a back extension 127, see FIG. 3*a*, that is pivotally attached to the arm rest assembly 115. The back extension 127 is in inoperative position or folded down, see FIG. 2*a*, against back portion 123 when the wheelchair frame is still attached to the bed frame and part of the bed combination 100 and folded up and locked as shown in FIG. 3*a* when the wheelchair 105 is removed from the slot 107.

The arm rest assembly 115 can also include a pair of pivotal arm rest parts 129 that move between a stored position when the wheelchair 105 is in the slot 107, see FIG. 3*a*, and an operative position when the wheelchair 105 is removed from the slot 107, see FIG. 3*a*. Each pivotal arm rest part 129 can be raised so as to cover a top of the side portion 125 of the arm rest assembly and provide more surface area for a patient to rest their arms when in the wheelchair 105. The arm rest parts pivot at 130 (FIG. 2*a*) to move between the stored and operative positions and hook over the top of the side portions 125 using the flange 132 (FIG. 3*a*).

Referring to FIGS. 1*d* and 4*a*-4*c*, the combination 100 has a first locking mechanism 128 that keeps the wheelchair 105 engaged to the bed frame 103 when the bed frame 103 is in a raised position and the wheelchair 105 is off the ground. The position with the wheelchair off the ground in shown in FIGS. 1*b* and 1*c*. In this position, the cushion of the wheelchair functions as part of the mattress of the bed as shown in FIG. 1*a* and the locking mechanism 128 ensures that the wheelchair 105 remains attached to the bed frame 103.

Figure 4A:
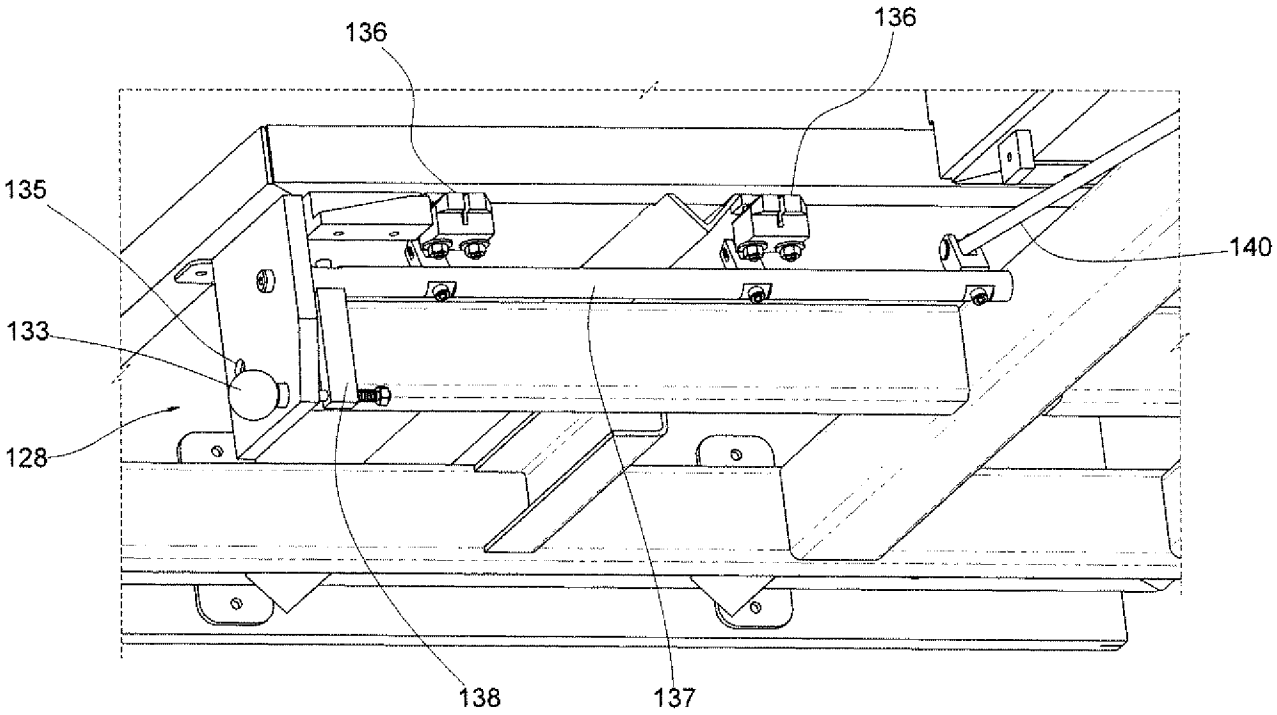
FIG. 4*a* is a view of a first mechanism that attaches the wheelchair to the bed when the bed is in the raised position in the unlocked state.
Figure 4B:
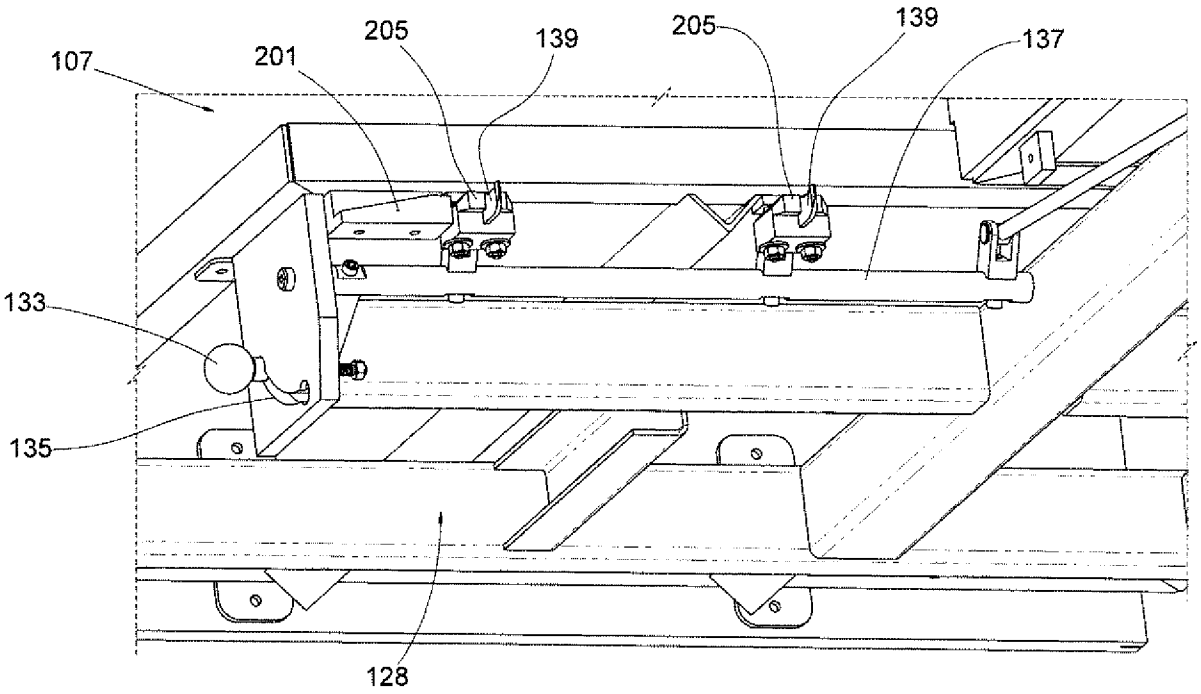
FIG. 4*b* is a view of the first mechanism of FIG. 4*a* in the locking state.

This locking mechanism 128 includes the knob 133 (FIG. 4*b*). Movement of the knob 133 in the slot 135 rotates the bar 137. The bar 137 has a pair of hooks 139 that are designed to engage obround slots 146 located in frame portions 144 of the wheelchair frame 111, see FIG. 2*b*.

FIG. 4*a* shows the knob 133 in the position in the slot 135 so that the hooks are not extended from the hook guides 136. In the locked state, the knob is moved in the slot and this rotates the bar 137 via the link 138, so that hooks 139 extend from the hook guides 136 and engage the slots 146 in the wheelchair frame 111. The arm rest assembly 115 is provided with clearance slots 141 that allow for the movement of the hooks 139 through the clearances slots 141 and engage the wheelchair frame as explained in more detail below with reference to FIGS. 6*a*-6*c*. It should be understood that the bar 137 and associated components are positioned on either side of the slots 146 so that a pair of hooks 139 engage each of the frame portions 144 of the wheelchair frame 111. The link 140, see FIG. 4*a*, actuates the bar 137 on the opposite side of the slot 107 from the knob 133. In the unlocked state, the hooks 139 are disengaged from the slots 146, which frees the wheelchair frame 111 from the bed frame 103.

Figure 6A:
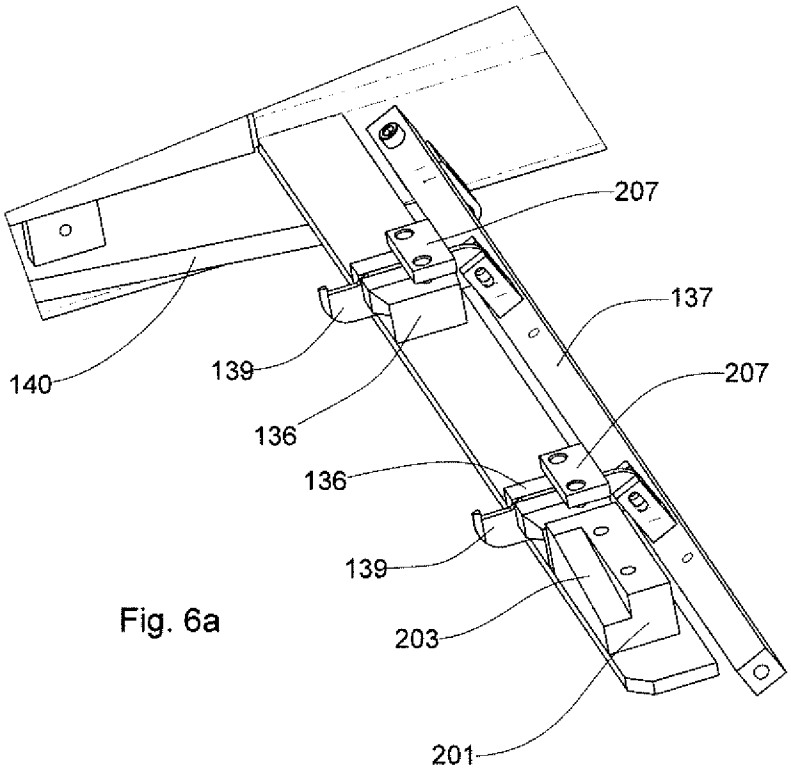
FIG. 6*a* shows the support structure that engages flanges extending from the side portions of the wheelchair, the engagement between the support structure and flanges allowing the arm rest assembly to be raised for wheelchair use as well as showing the locking mechanism with the hooks in the extended position.
Figure 6B:
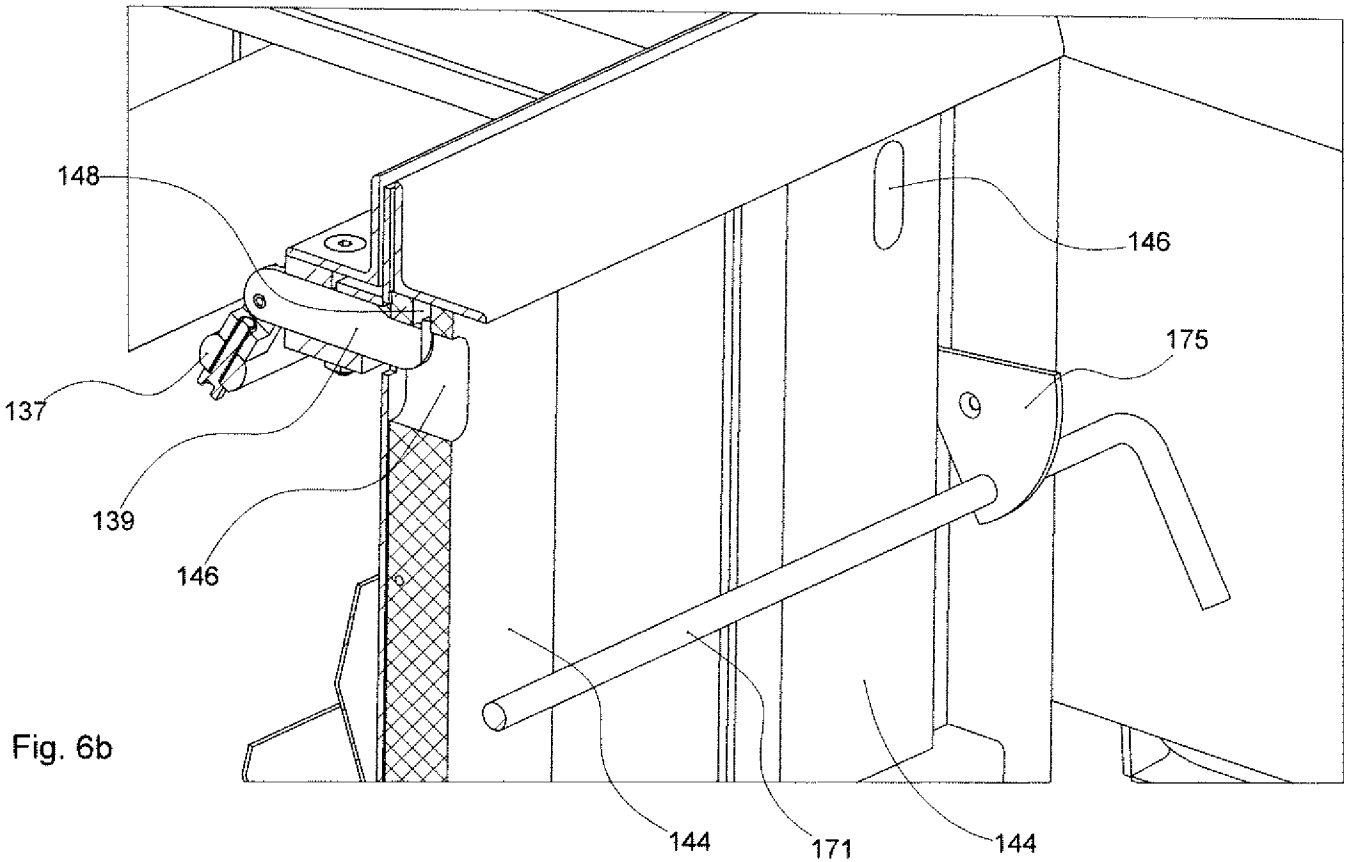
FIG. 6*b* is a perspective sectional view of a portion of the wheelchair and bed combination that better illustrates the locking mechanism that secures the wheelchair frame to the bed frame.
Figure 6C:
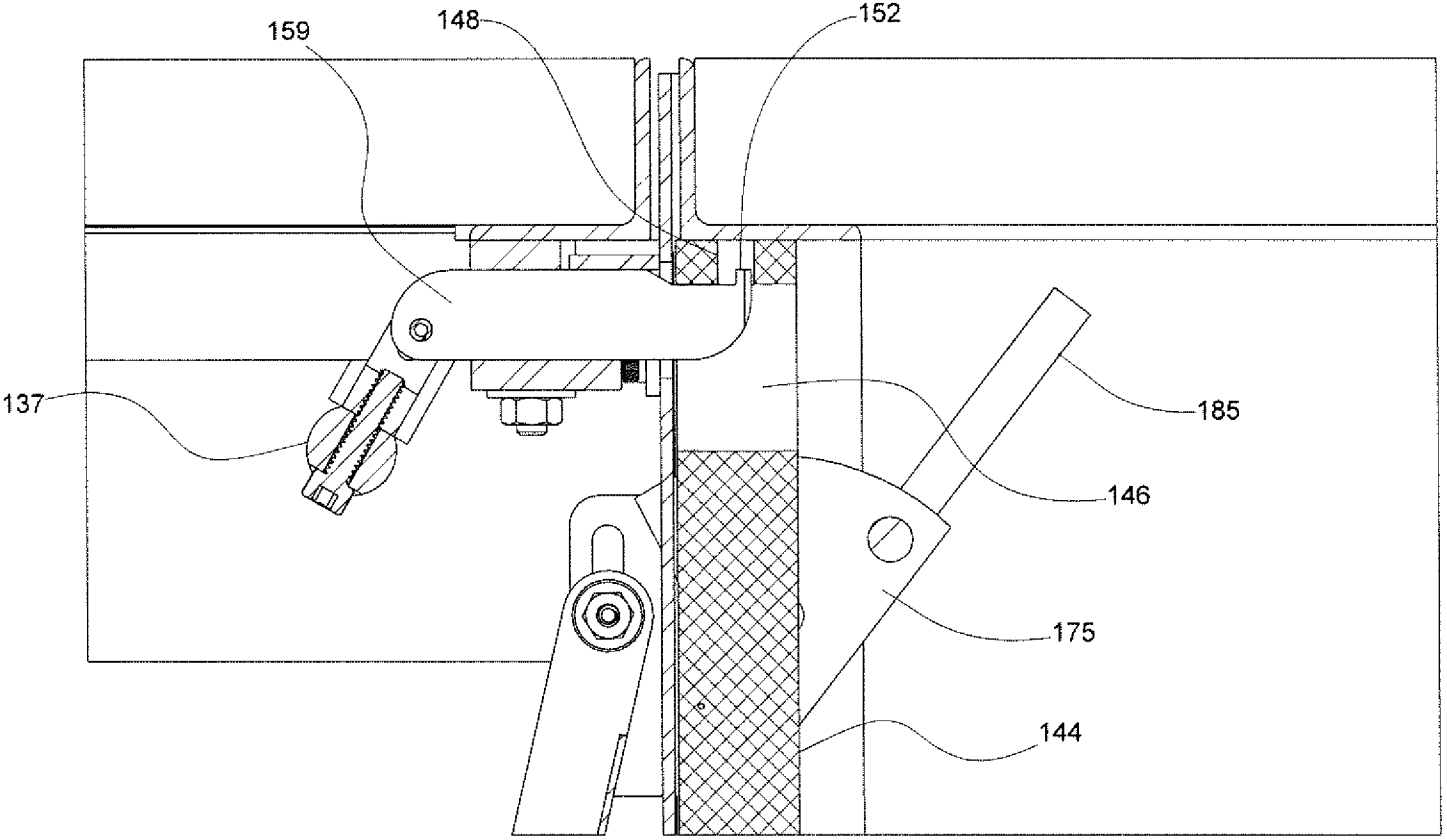
FIG. 6*c* is side sectional view similar to FIG. 6*b* showing the locking mechanism in an engaged position.

With reference to FIGS. 6*a*-6*c*, FIG. 6*a* shows the hooks 139 in the extended state but without the wheelchair 105 in the slot 107. FIGS. 6*b* and 6*c* show the engagement between the hooks 139 and the wheelchair frame 111. Each frame portion 144 has both the slot 146 and a cross drilled bore 148. The hook 139 has a tip 152 that is designed to engage the bore 148. This engagement prevents the hook 139 from being removed from the slot 146 when the locking mechanism is in its operative position to attach the wheelchair frame 111 to the bed frame 103.

Figure 1D:
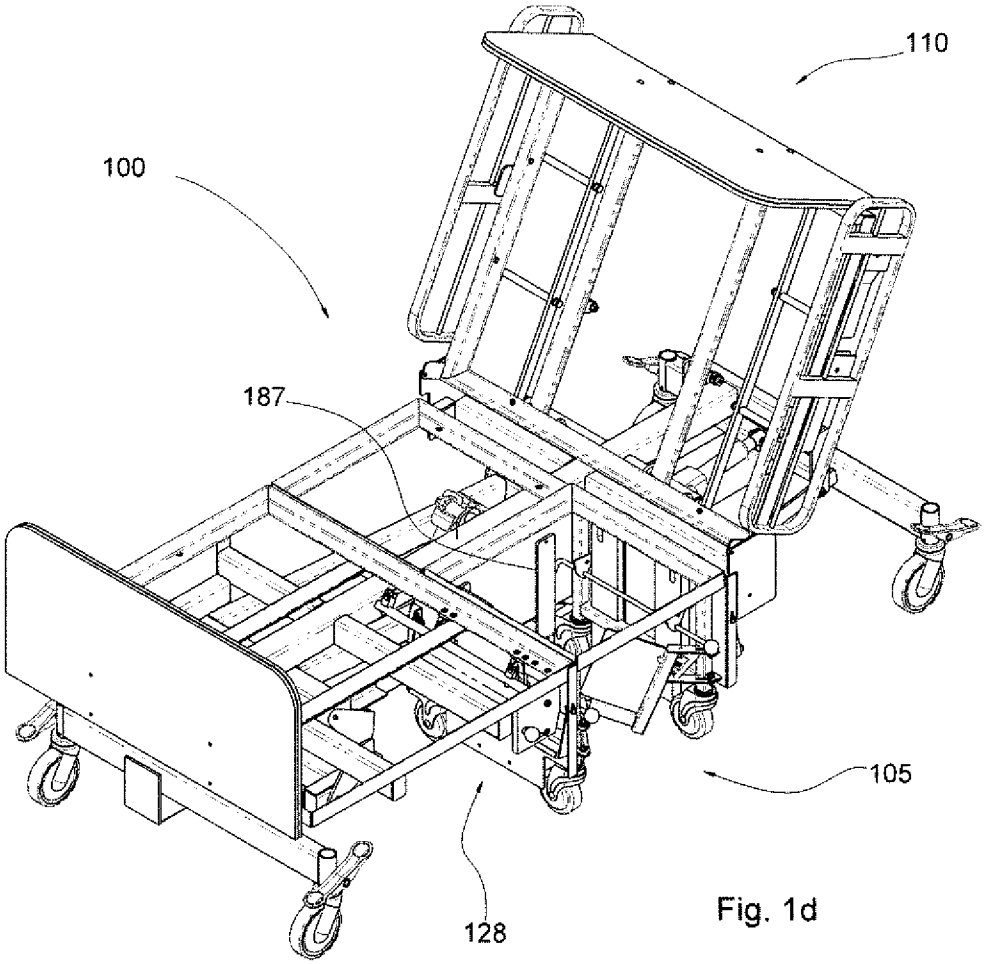

The locking mechanism 128 has a dual purpose in that it secures the wheelchair to the bed frame and also controls the movement of the arm rest assembly 115. The arm rest assembly is moveable with respect to the wheelchair frame 111 between a raised position and a lowered position. When the bed frame 103 is in the lowered position as shown in FIG. 1*d*, the knob 133 is in the locked positioned and the wheelchair frame 111 is secured to the bed frame via the locking mechanism 128. The arm rest assembly 115 is also removably secured to the bed frame in another way that allows the bed frame to move the arm rest assembly to form a configuration of a wheelchair as described below.

One embodiment of this removable securing of the arm rest assembly to the bed frame is now described. The side portion 125 of each arm rest assembly 115 has a flange 143 extending from an outer side surface of the side portion 125, see FIG. 2*b*. Each flange 143 is designed to engage one or more surfaces of the bed frame so when the bed frame is raised, the arm rest assembly is raised to configure the wheelchair for use.

Referring to FIG. 6*a*, the bed frame 103 include a ramp block 201 with a ramp surface 203. Positioned above the guides 136 on each side of the slot are support blocks 205 with support surfaces 136. Referring to FIG. 1*b*, with the bed frame in the raised position and the locking mechanism 128 in its operative position, the hooks 139 are engaged with the slots 146 in the frame portions of the wheelchair frame 111, see FIGS. 6*b* and 6*c*.

Still referring to FIGS. 6*a*-6*c*, the engagement between the hooks 139 and slots 146 is shown with the wheelchair and bed in the raised position, see FIG. 1*b*. When the bed frame 103 is lowered as shown in FIG. 1*d*, and the locking mechanism 128 is released, the engagement between the support surfaces 136 and underside of the flanges 143 remains. When the bed frame 103 is lowered and the wheelchair contacts the ground, the bed frame 103 is configured to allow the wheelchair frame 111 to move with respect to the bed frame 103. This movement is in the upward direction such that the wheelchair frame portions 144 are moved with respect to the hooks 139 of the locking mechanism 128. With reference to FIG. 6*c* in particularly, the frame portion 144 moves upwardly with respect to the hook 139 when the wheelchair is placed on the ground. This upward movement allows the tip 152 of the hook 139 to be free of the bore 148 in the frame portion 144. In this configuration, the rotation of the rod 137 of the locking mechanism 128 moves the hook 139 laterally out of the slot 146 and clearance slot 141 in the arm rest assembly. The wheelchair frame portions 144 are now freed from attachment to the bed frame 103.

With the wheelchair disengaged from the bed frame 103 via release of the locking mechanism 128, the arm rest assembly is free to move with respect to the wheelchair frame via the connection between the flange 143 of the side portions 125 of the arm rest assembly 115 and support surfaces 136 of the bed frame. Thus, raising of the bed frame 103 raises the arm rest assembly, see FIG. 1*e*. As described below, the arm rest assembly can be then secured in its raised position so that the wheelchair can be removed from the slot 107 and be used with a patient from the bed.

Figure 5A:
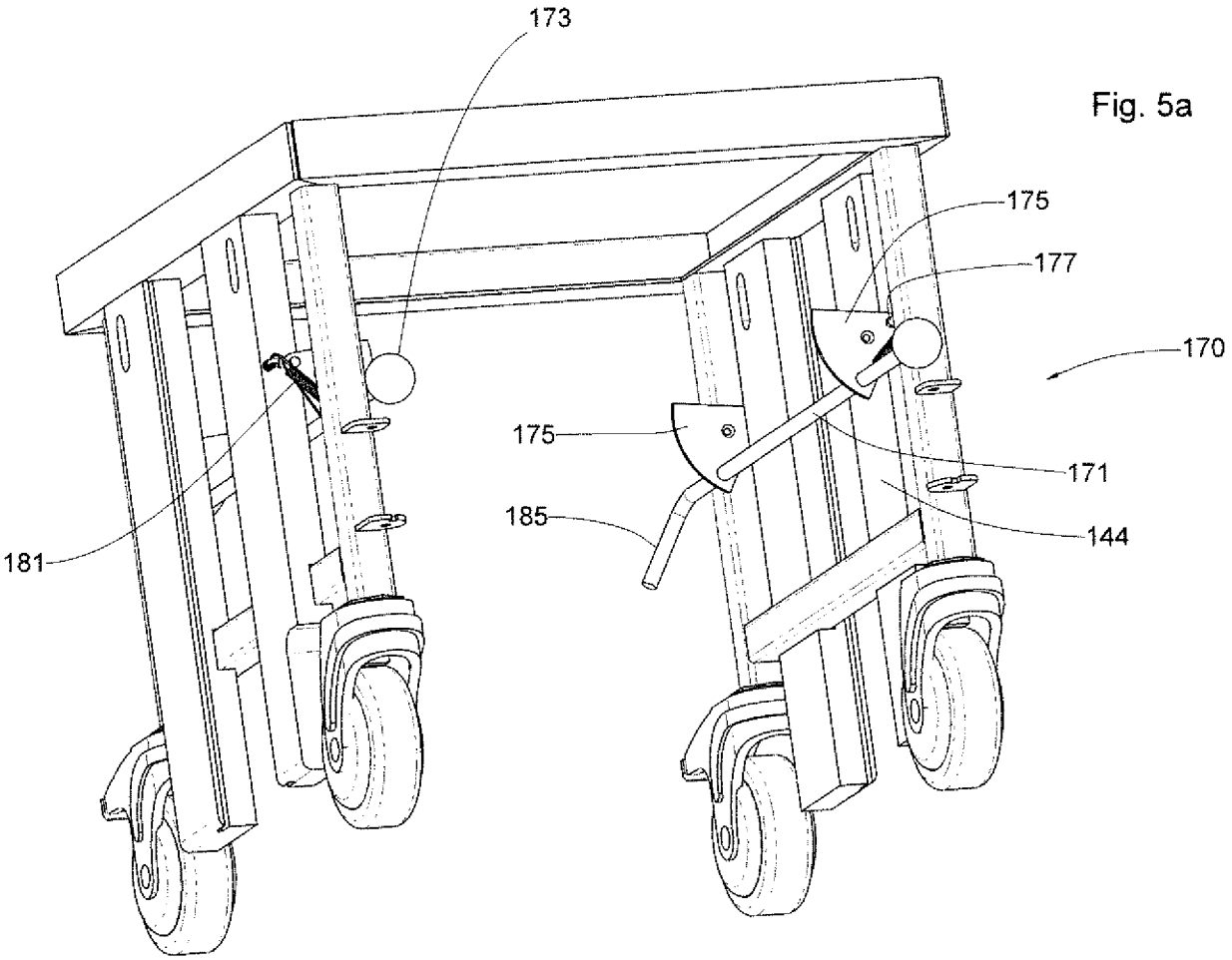
FIG. 5*a* is a view of a second mechanism shown in a first position that keeps the wheelchair attached to the bed assembly when the wheel chair is in the lowered position and the first mechanism is released.
Figure 5B:
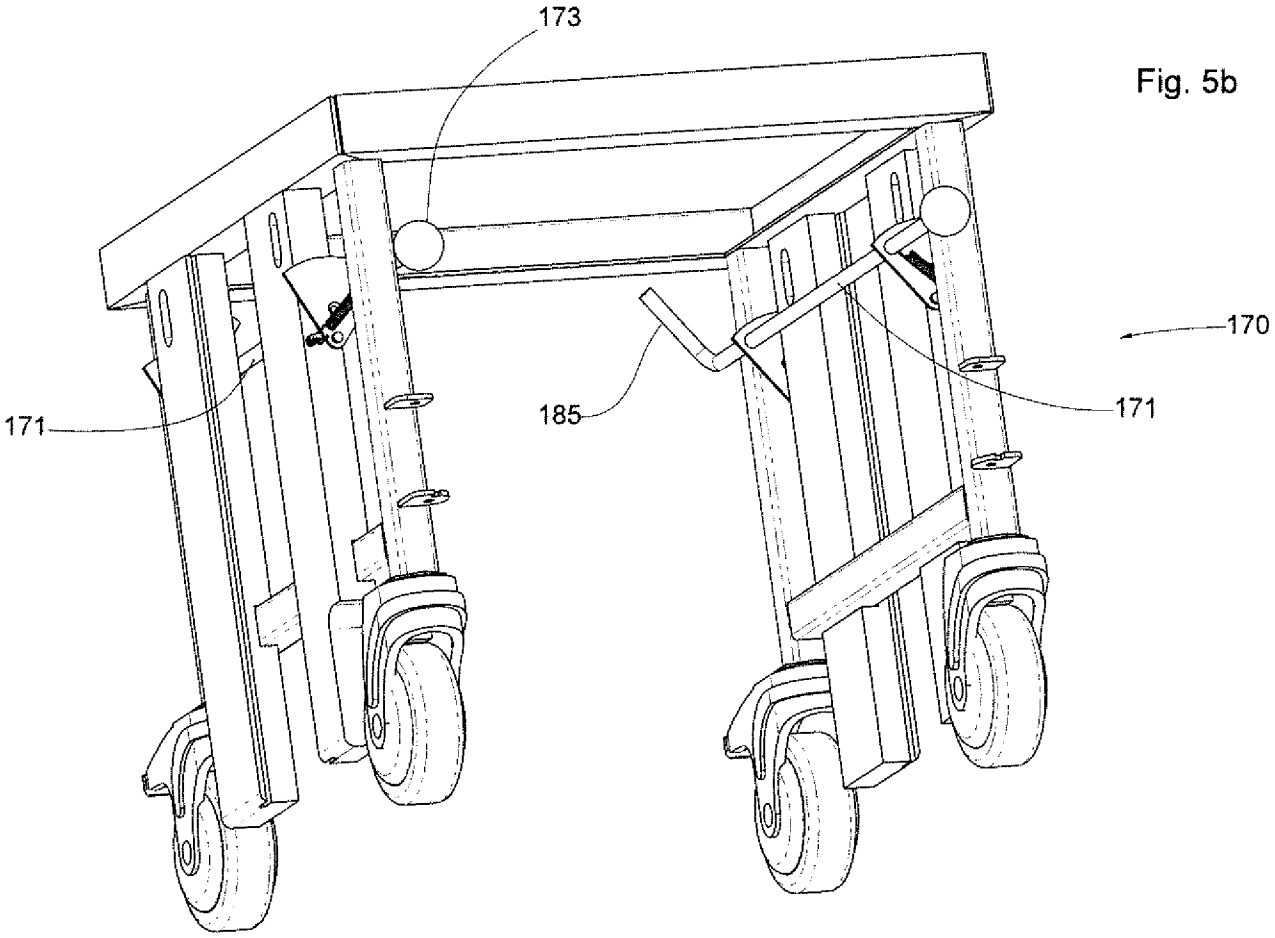
FIG. 5*b* shows the second mechanism of FIG. 5*a* in a second position, which releases the wheelchair from the bed and at the same time keeps the arm rest assembly in its raised position.

An additional or second locking mechanism is designated by the reference numeral 170, see FIGS. 5*a* and 5*b*. This locking mechanism 170 functions at least to keep the arm rest assembly 115 in the raised position after the locking mechanism 128 is released and the wheelchair 105 is removed from the slot 107. Since the arm rest assembly 115 can move with respect to the wheelchair frame 111, if the arm rest assembly 115 is not supported by a mechanism other than the bed frame, the arm rest assembly would drop down below the seat 106.

The locking mechanism 170 has a pair of rods 171 that are movable between a first and second position via rotation of the knob 173. Each rod 171 is connected to a pair of plates 175, each plate pivotally mounted at 177 to the frame part 144 of the wheelchair frame 111. Each plate 175 is also over center spring biased using an over center spring 181, the over center spring bias directed outward of the wheelchair frame. In other words, the plates 175 are biased outwardly as shown in FIG. 5*b*.

Figure 1E:
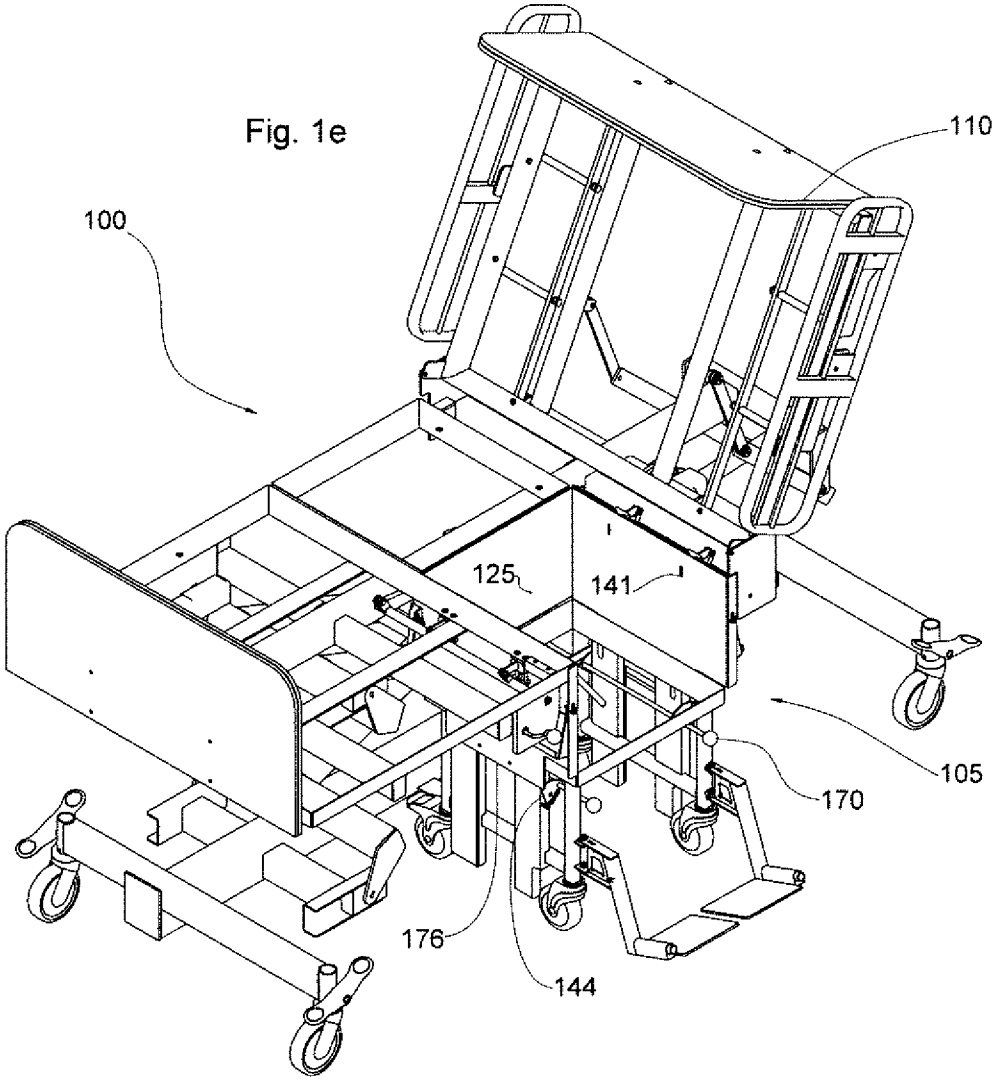
Figure 1F:
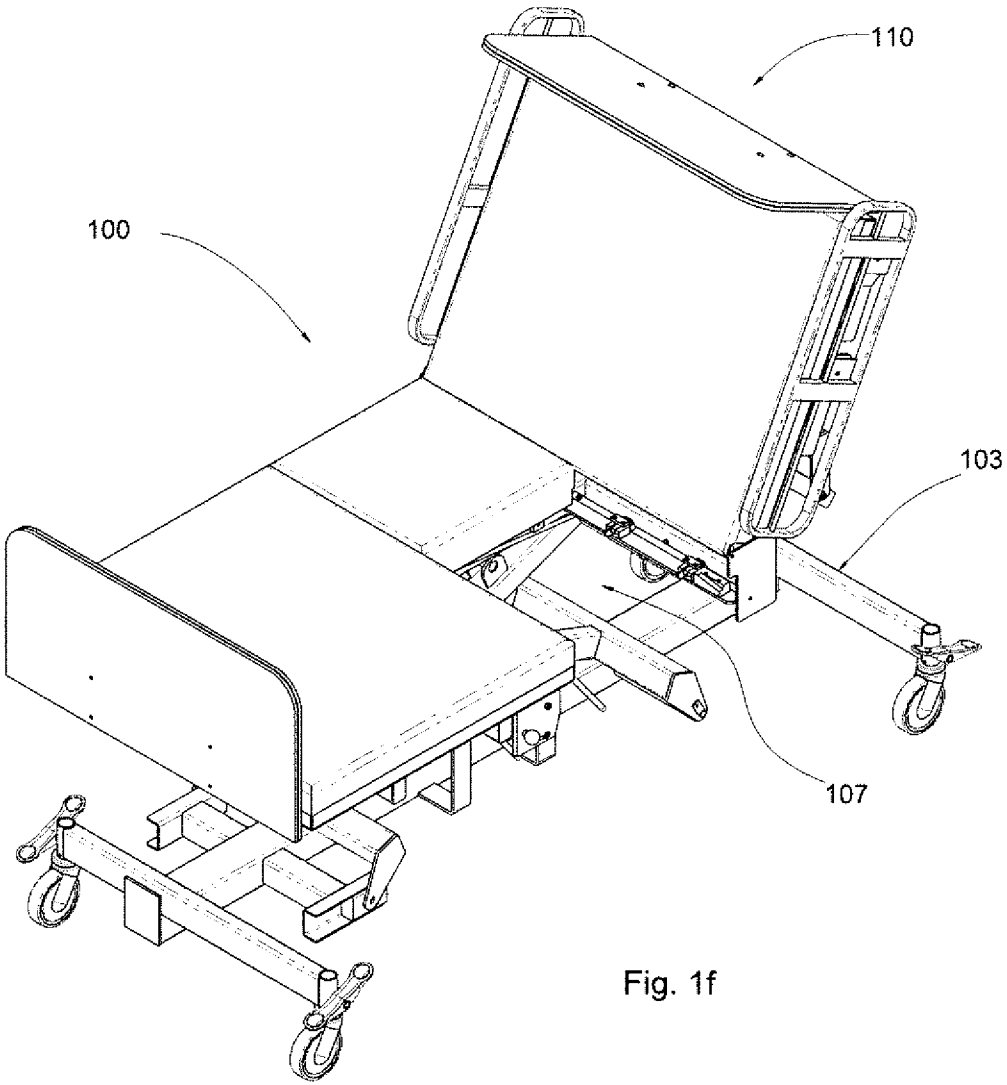

Each plate 175 is designed to contact a lower edge 176 of the arm rest assembly 115 in the first position and keep the arm rest assembly 115 in a raised position, see FIG. 2*a*. This engagement position is also shown in FIG. 1*e* by reference numeral 183.

The second locking mechanism or arm rest assembly supporting mechanism 170 can also have an additional wheelchair locking feature, see FIGS. 5*a* and 5*b*. That is, the end of the rod 171 can have a hook portion 185. The hook portion 185 engages a part 187 of the bed frame 103, see FIG. 1*d* when the rod is in a second position, wherein the arm rest assembly 115 is in its lowered position and the plate 175 is not in supporting contact with the edge 176 of the arm rest assembly 115. With the hook portion 185 engaging the part 187 of the bed frame 103, the wheelchair 105 cannot be removed from the slot 107. With the hook portion 185 present, the second locking mechanism 170 performs a dual function. One function in a first position is to support the arm rest assembly 115 and allow the wheelchair 105 to be removed from the slot 107. A second function in the second position is to keep the wheelchair 105 attached to the bed frame 103 even though the wheelchair frame 111 is disengaged from the bed frame 103 via release of the first locking mechanism 128. It should be understood that the hook portion 185 is optional and that the additional locking mechanism could be just for the purpose of keeping the n rest assembly 115 in its raised positioned after the bed frame 103 is raised and the wheelchair is ready to be removed from the slot 107.

In operation, the patient is first laying on the mattress 101 and wheelchair seat 106. The wheelchair 105 is in a raised position where the wheels 117 of the wheelchair 105 do not touch the ground (FIG. 1*b*). In this mode, the wheelchair frame is secured to the bed frame using the locking mechanism 128.

The patient is then positioned so that the patient is sitting on the wheelchair seat 106, see FIG. 1*b*. The bed frame 103 with the patient on the seat 106 is lowered to a first position so that the wheels 117 of the wheelchair 105 are on the ground (see FIG. 1*d*). The lowering of the bed frame 103 also lowers the wheelchair frame 111, arm rest assembly 115, and the seat 106 as the bed frame 103 and wheelchair 105 are connected together via the locking mechanism 128 when the bed frame is in the raised position.

After the lowering of the bed frame 103 and wheelchair 105, the wheelchair frame 111 can be disengaged from the bed frame 103 by unlocking the first wheelchair locking mechanism 128 but the arm rest assembly 115 still remains engaged with the bed due to the engagement of the flanges 143 with the support surfaces 136, see FIG. 6*a*.

Once the wheelchair frame 111 is disengaged from the bed frame 103, the bed frame 103 is raised up, FIG. 1*e*. The disengagement of the wheelchair frame 111 and bed frame 103 means that the wheelchair 104 remains on the ground. Since the arm rest assembly 115 is still engaged to the bed via the flanges 143 and support surfaces 136, the raising of the bed frame also raises the arm rest assembly 115 with respect to the wheelchair frame 111, see FIG. 1*e*. The bed frame 103 and arm rest assembly 115 raising exposes an inner surface of the arm rest assembly 115 and creates a space that provides stability for the patient. That is, the back and sides of the patient become surrounded by the arm rest assembly 115, thus helping the patient remain seated in an upright position on the wheelchair seat 106 while the bed is being raised.

With the bed and aim rest assembly raised and wheelchair still on the ground, the additional locking mechanism 170 is used. This additional locking mechanism 170 keeps the arm rest assembly 115 in the raised position, see FIGS. 1*e* and 1*f* the hook portion 185 is included on the rod 171 as an additional locking mechanism, securing the arm rest assembly 115 in its raised position using the plates 175 of the additional locking mechanism 170 also rotates the hook portion 185 so that it disengages the hook portion 185 from the bed frame portion 187, see FIGS. 1*d* and 1*e*, thus allowing the wheelchair 105 to be removed from the slot 107.

To put the patient back into the bed, the wheelchair 105 is moved into the slot 107 when the bed is in the raised position, and the flanges 143 again engage the surfaces 136. As part of this movement of the wheelchair, the undersides of the flanges ride on the ramp surface 203 of the ramp block 201 to more easily guide the flanges 143 to rest on the support surfaces 136 of the support blocks. The slot 107 is dimensioned so that when the wheelchair is moved into the slot 107, the clearance slots 141 of the side portions 125 of the arm rest assembly 115 being aligned with the hooks 139 of the locking mechanism 128 so that the wheelchair frame 111 can be secured to the bed frame 103 and the wheelchair seat 106 can be used to complete the formation of the mattress of the bed.

The additional locking mechanism 170 is then operated to disengage the plates 175 from the arm rest assembly 115, and if the hook portion 185 is present, engage the bed frame part 187 with the hook portion 185. The arm rest assembly 115 is held in place by the engagement between the flange 143 and surfaces 136 but is free to move with respect to the wheelchair frame 111.

The bed frame 103 is then lowered with the patient still on the seat 106 of the wheelchair. This lowering of the bed frame moves the released arm rest assembly 115 down so that the seat 106 is aligned with the mattress of the lowered bed, FIG. 1*d*. The first locking mechanism 128 is employed so that the wheelchair frame 111 is secured to the bed frame 103. The bed frame 103 is then raised and since the wheelchair frame 111 is connected again to the bed frame 103, the wheelchair frame 111 is lifted off of the ground and the seat 106 and mattress of the bed remain aligned and the patient can use the bed in its raised position, FIG. 1*b*. The change in the position of the arm rest assembly 115 is evident from FIG. 7*d*, wherein the side portion 125 is shown in its lowered position so that the seat 106 of the wheelchair can align with the mattress of the bed.

One advantage of the wheelchair and bed combination is that the wheelchair does not need any separate actuator, either mechanical or electrical, to be removed from the bed or to be operational as a wheelchair. The actuator that moves the bed frame does the work in combination with the arm rest assembly 115 being movable with respect to the wheelchair frame and removably secured to the bed frame. That is, when the bed is in the raised position for use by the patient, the arm rest assembly is attached to the bed frame so that the seat of the wheelchair functions as part of the mattress of the bed.

When the bed is in the lowered position and the wheelchair is placed on the ground so that the patient can use the wheelchair, the arm rest assembly is lowered with respect to the wheelchair frame. When the wheelchair frame is disengaged from the bed frame and the bed is raised as part of the intended release of the wheelchair, the arm rest assembly remains connected to the bed and the arm rest assembly is raised with respect to the wheelchair frame so as to create a u-shaped space around the wheelchair seat, which is occupied by the patient. So, the bed frame has two functionalities in its raised position. With the wheelchair attached to the bed frame, the wheelchair seat forms part of the mattress. When the wheelchair is released from the bed frame by operation of the locking mechanism 128, raising the bed functions to raise the arm rest assembly and create the back and side parts of the wheelchair for use by the patient.

Again, the additional locking mechanism can optionally also include the second feature wherein the wheelchair remains connected to the bed frame when the bed frame and arm rest assembly are raised. This provides an additional safety feature which keeps the wheelchair securely in the slot of the bed even though the wheelchair frame is no longer attached to the bed frame due to release of the locking mechanism 128 and until such time as the arm rest assembly is raised to create a wheelchair configuration. With this optional feature, the activation of the additional locking mechanism can both lock the arm rest assembly in its raised position and release the wheelchair from the bed. The wheelchair can then be removed from the slot with the patient in it and the patient can be moved using the wheelchair for a desired purpose.

Figure 7A:
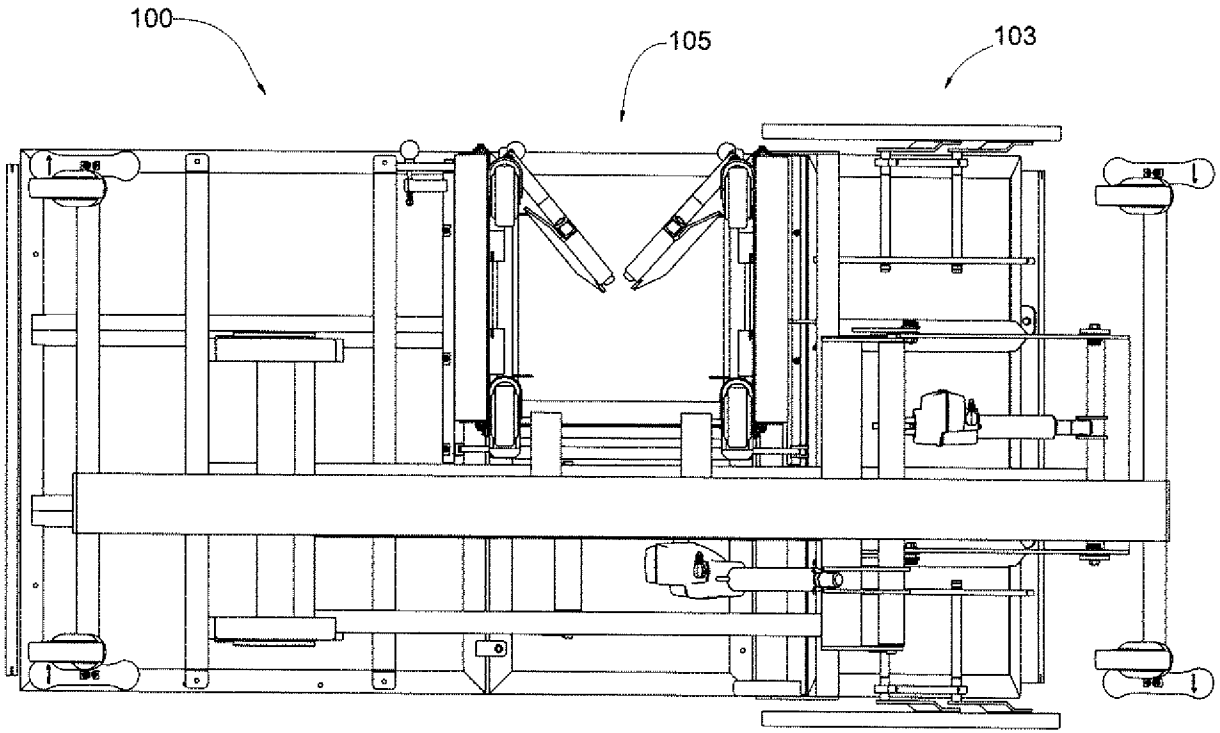
FIG. 7*a* shows a bottom view of the wheelchair and bed combination.
Figure 7B:
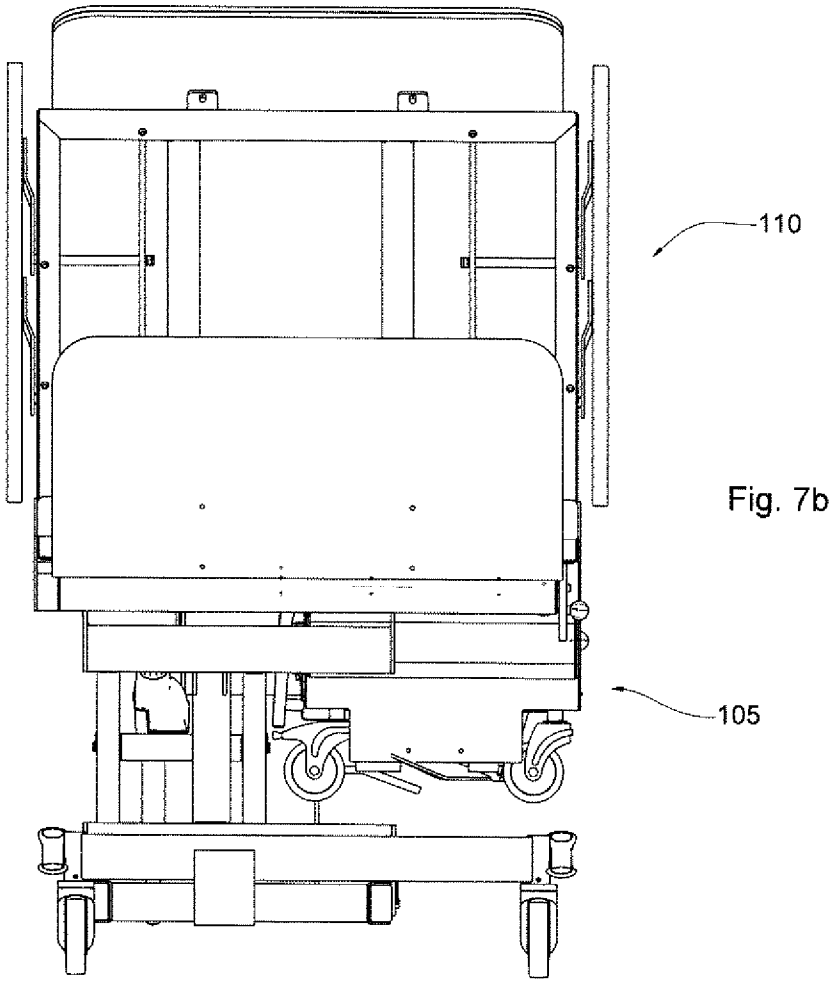
FIG. 7*b* shows a front view of the wheelchair and bed combination.
Figure 7C:
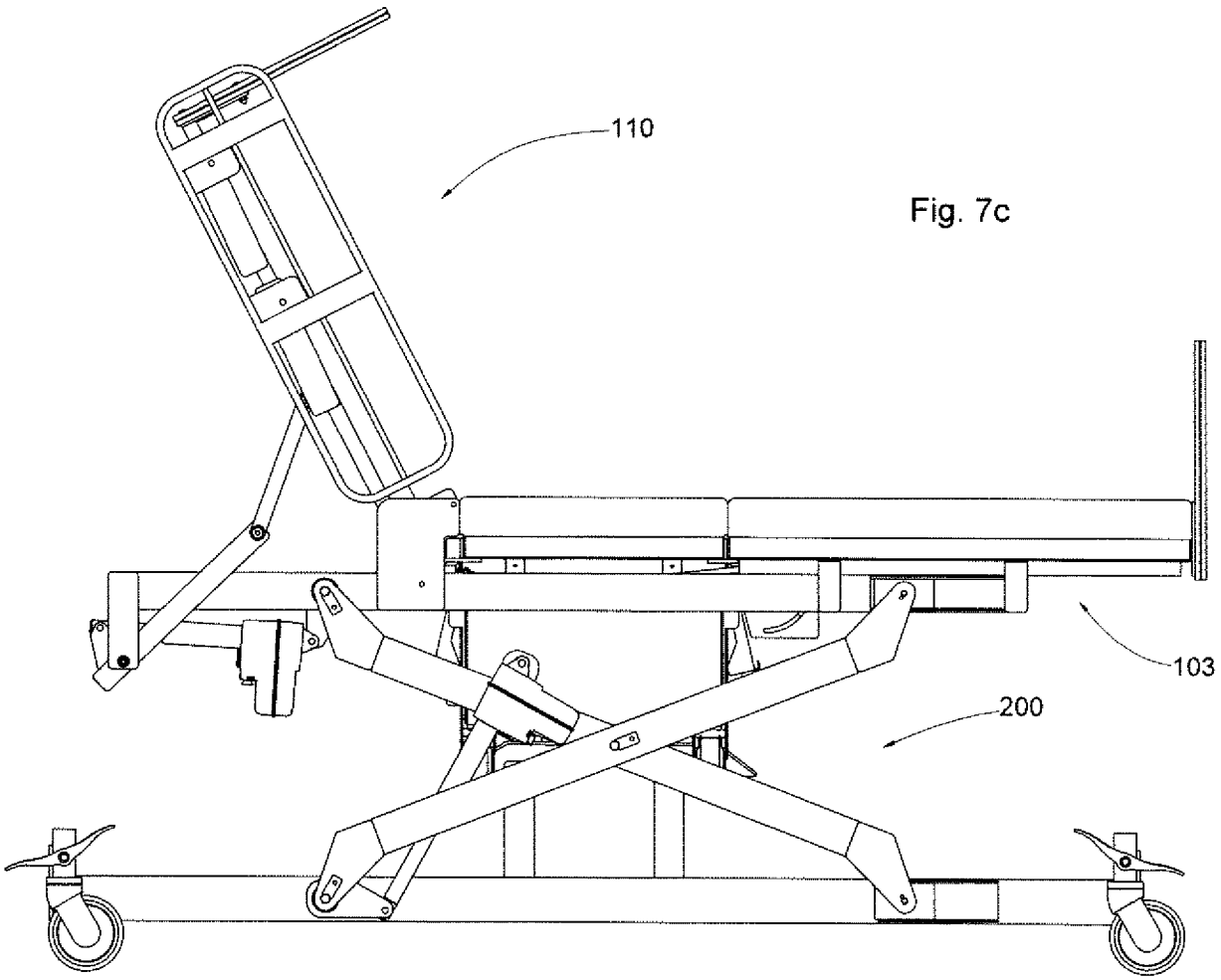
FIG. 7*c* shows a left side view of the wheelchair and bed combination.
Figure 7D:
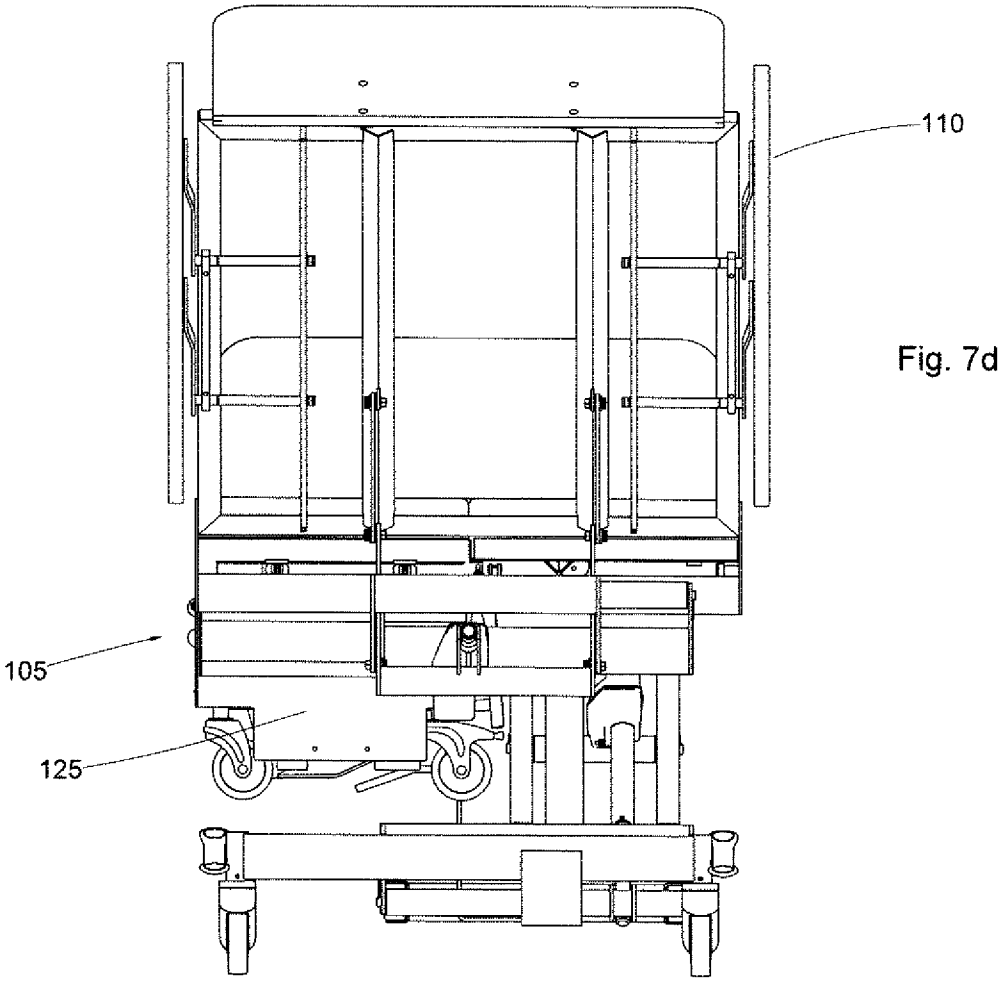
FIG. 7*d* shows a rear view of the wheelchair and bed combination.
Figure 7E:
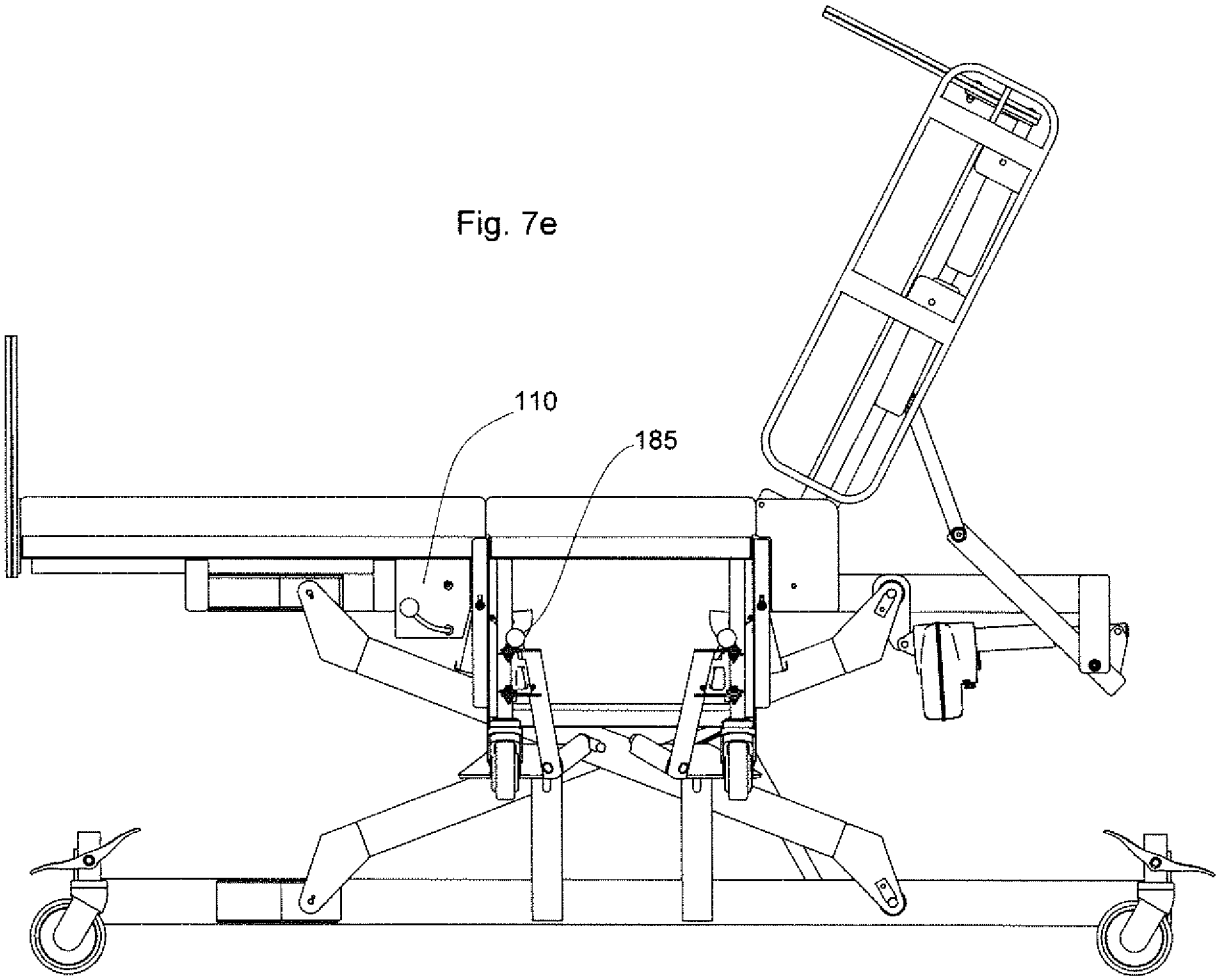
FIG. 7*e* shows a right view of the wheelchair and bed combination.
Figure 7F:
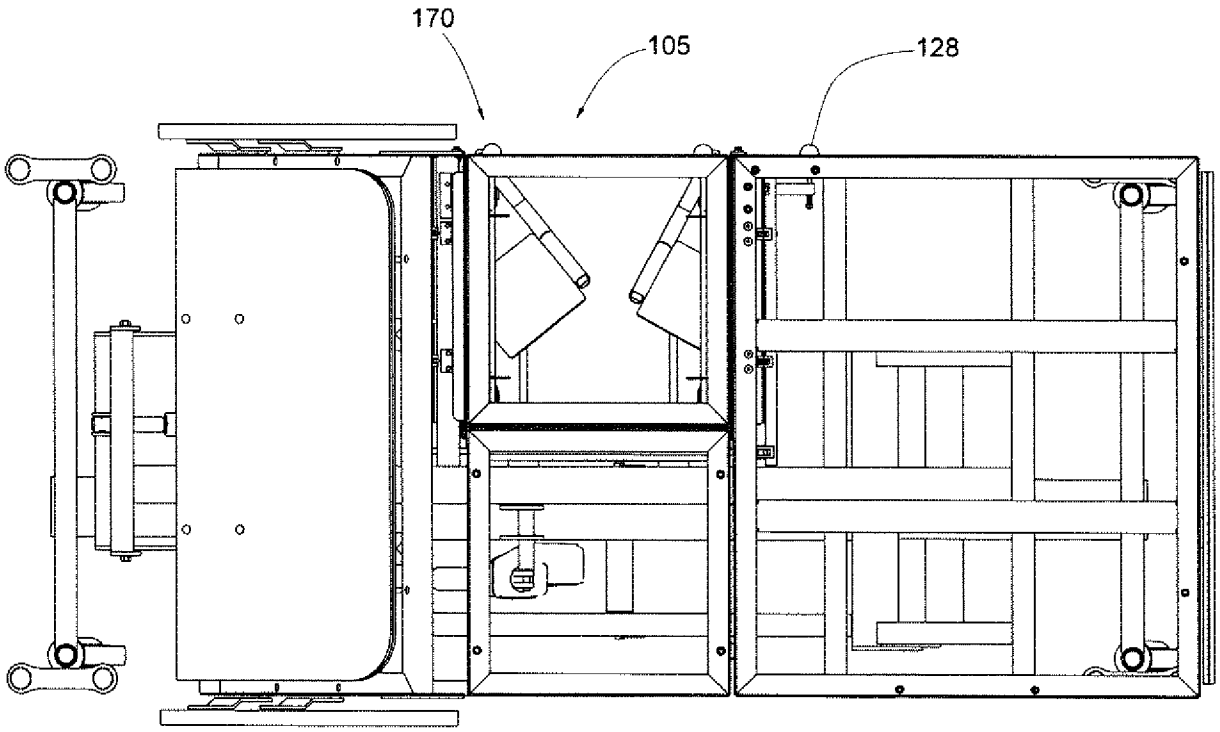
FIG. 7*f* shows a top view of the wheelchair and bed combination.
Figure 8A:
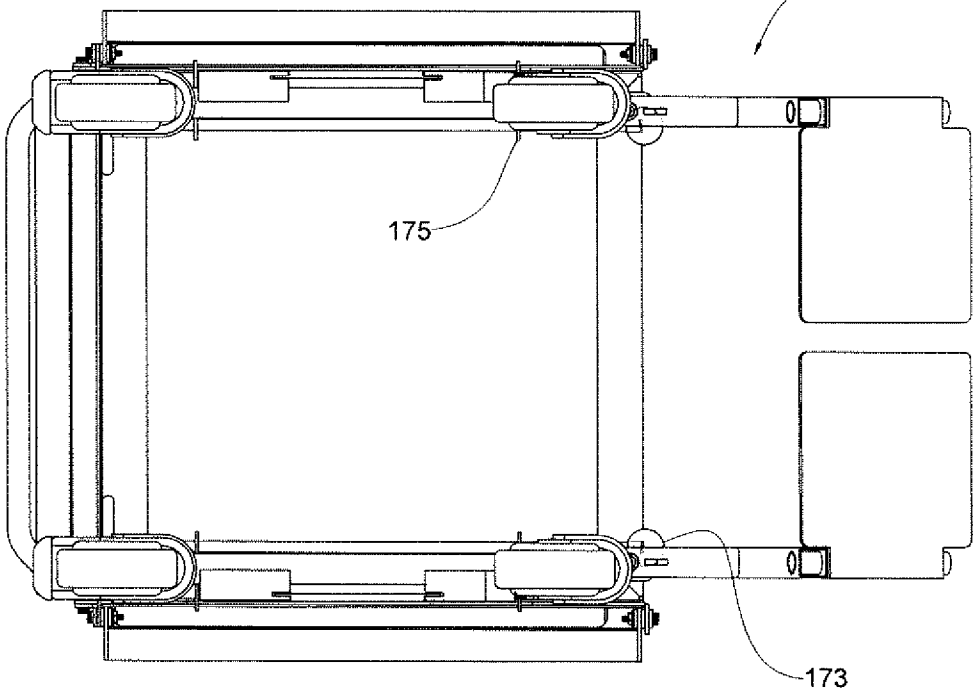
FIG. 8*a* shows a bottom view of the wheelchair.
Figure 8B:
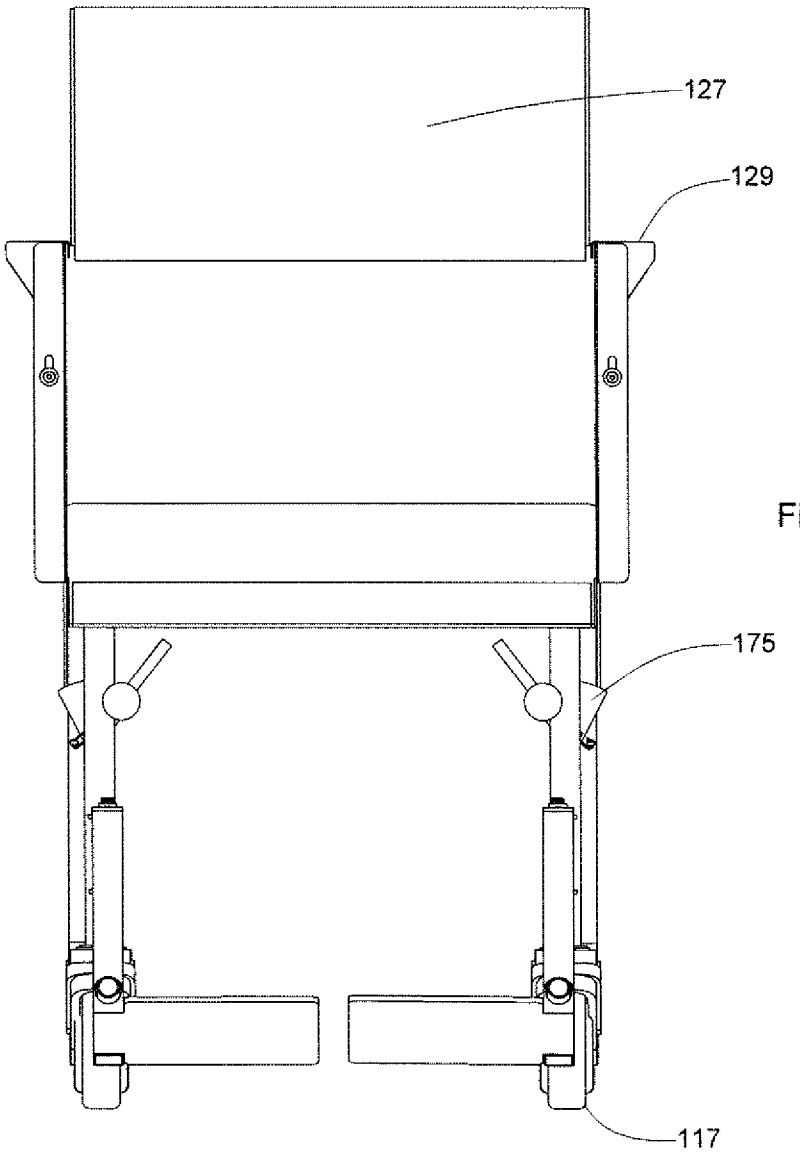
FIG. 8*b* shows a front view of the wheelchair.
Figure 8C:
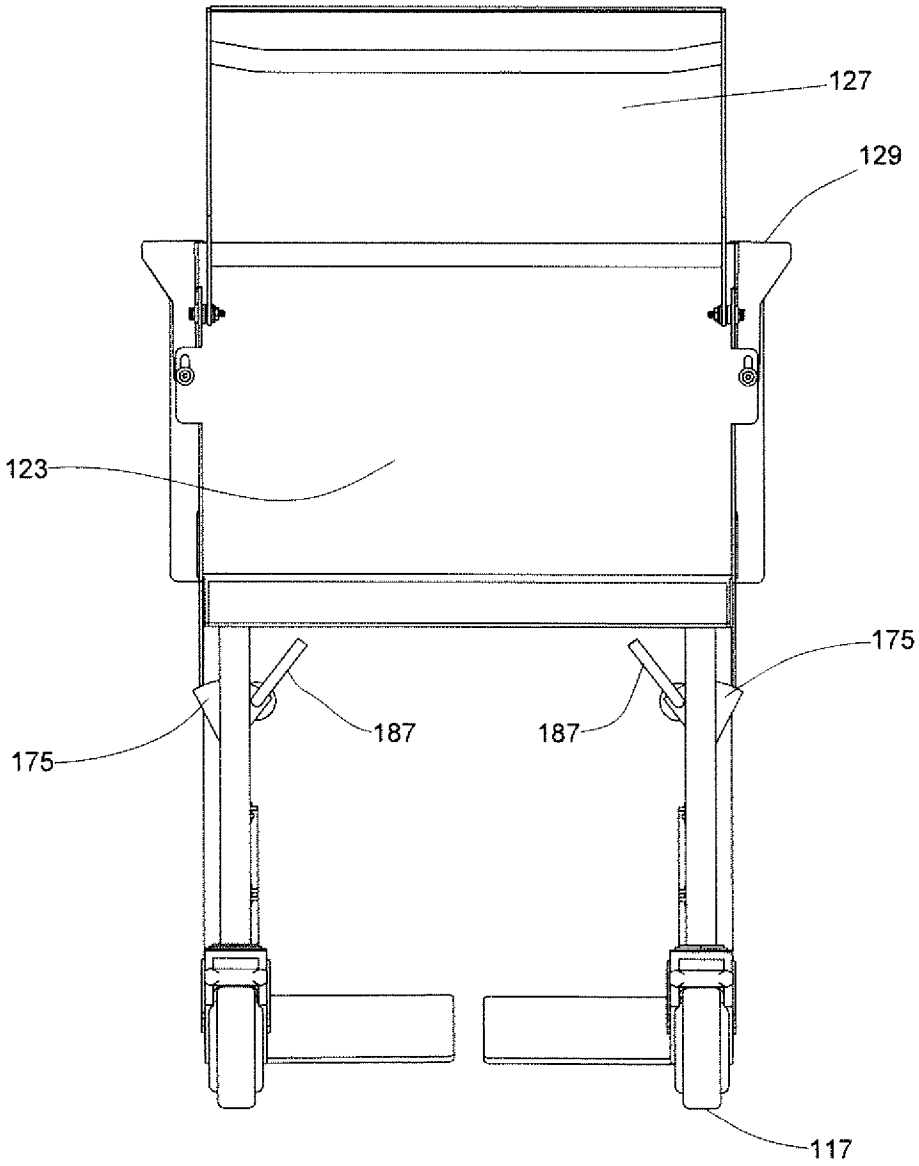
FIG. 8*c* shows a rear view of the wheelchair.
Figure 8D:
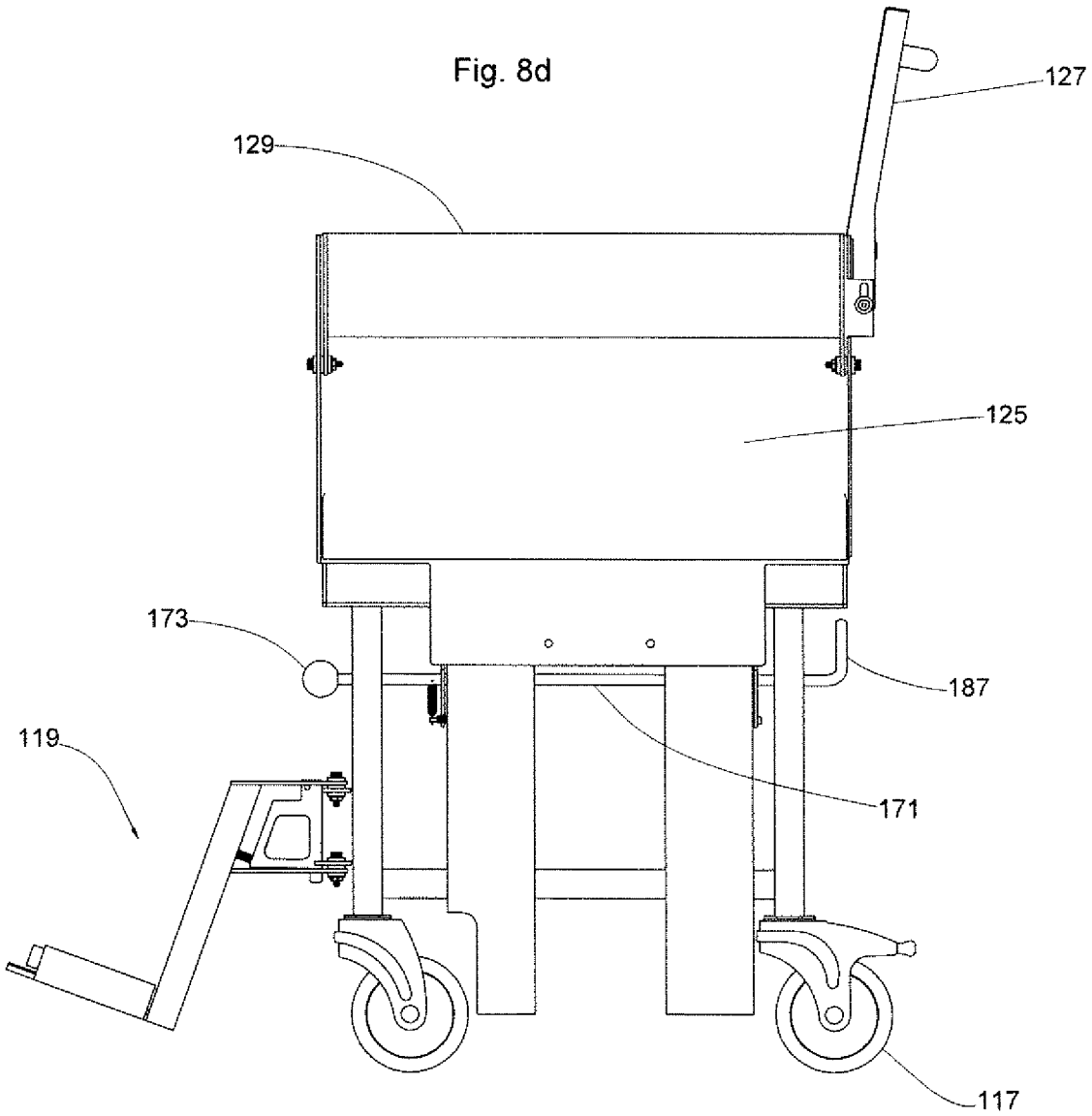
FIG. 8*d* shows a right side view of the wheelchair.
Figure 8E:
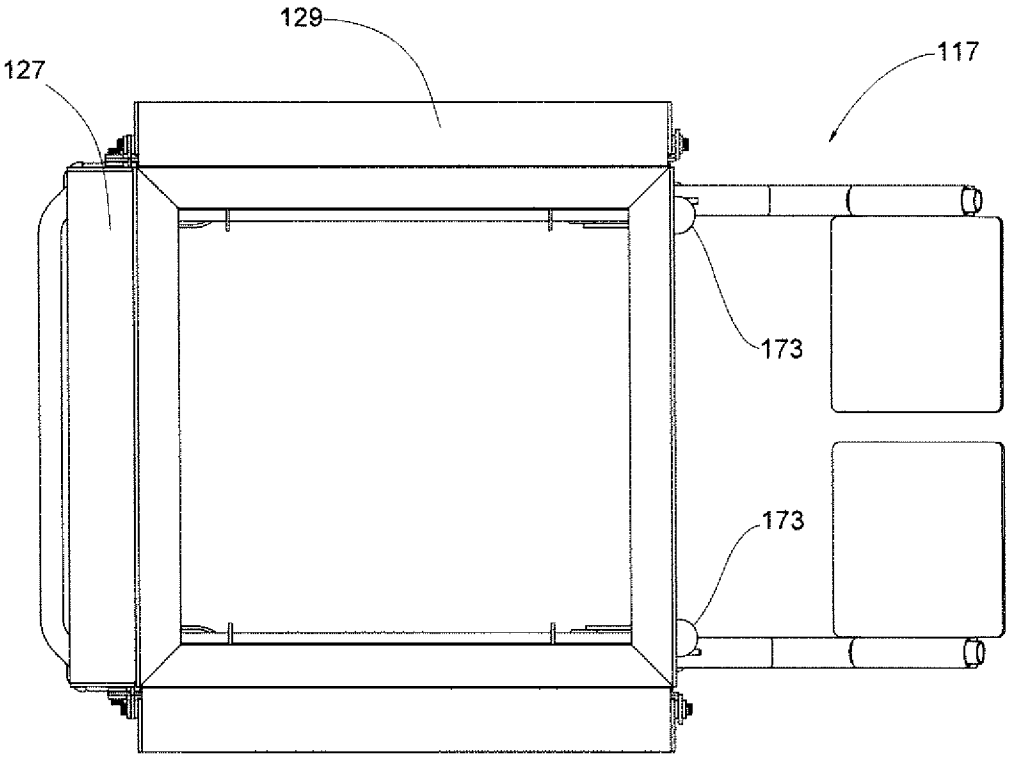
FIG. 8*e* is a top view of the wheelchair.

Referring to FIGS. 7*a*-7*f*, the bed frame 103 is shown with a scissors lifting mechanism 200 (FIG. 7*c*). This is just an example of the mechanism that can be used to raise the bed when the patient is using the bed and raising the bed when the wheelchair is to be used by a patient. For example, one lifter or multiple lifters that move vertically could be used to raise the bed frame. While a movable head support 110 is disclosed, the bed could also be made with a movable foot support as well and the actuators for the movable parts of the bed frame can be any known type. The wheels and wheel locks of the bed are conventional and a further description of them is not needed for understanding of the invention. Moreover, the structural features of the bed as illustrated are exemplary only and other structural designs could be employed for the bed frame, the mattress support, and the like.

Likewise, the locking mechanism 128 and additional locking mechanism 170 are only examples of locking mechanisms that can be used as part of the wheelchair and bed combination. Other locking mechanisms can be employed that would secure the wheelchair to the bed frame so that the bed mattress and seat of the wheelchair are aligned for bed use by the patient (here the wheelchair is in its raised position). For example, other parts of the frame of the wheelchair could be made attachable and detachable to the bed frame instead of the parts 144.

Instead of the rotatable rod and hook configuration of mechanism 128, an actuator (electric or hydraulic) could be employed that secured the arm rest assembly to the bed frame. Similarly, the locking mechanism on the wheelchair that retains the arm rest assembly in its raised position can take on other configurations, including actuators and the like. The advantage of the additional locking mechanism 170 is that it is purely mechanical and no power source is required on the wheelchair to keep the arm rest assembly in place when the wheelchair is in use.

While the mattress 101 in FIG. 1*a* is shown in three pieces, it could be made in one piece or two pieces if desired.

The configuration of the bed frame to provide a support for the arm rest assembly 115 is also only an example of the functionality of having structure on the arm rest assembly and structure on the bed frame, wherein after the wheelchair is disengaged from the bed frame, the arm rest assembly is raised with raising of the bed to form the space for a patient to sit and complete the configuration of the wheelchair. For example, the ramp block can be optional such that when the wheelchair enters the slot, a surface on the arm rest assembly directly engages a support surface on the bed frame. The bed frame support surface could be an elongated surface rather than spaced apart surfaces as illustrated.

As such, an invention has been disclosed in terms of preferred embodiments thereof which fulfills each and every one of the objects of the present invention as set forth above and provides a new and improved wheelchair and bed combination and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A wheelchair and bed combination comprising a bed assembly; and a wheel chair, the bed assembly comprising a bed frame, a mattress, the mattress and bed frame including a slot therein, and means for moving the bed at least up and down and between at least a raised position and a lowered position;

the wheelchair comprising a wheelchair frame, wheels, an arm rest assembly having a back portion and two side portions, a wheel chair seat, and an arm rest supporting mechanism, the wheelchair frame removably attachable to the bed frame, wherein the wheelchair frame is attached to the bed frame using a first locking mechanism when the bed frame is in a raised position with the wheelchair seat generally aligned with the mattress to form a bed surface for a patient lying on the bed, and releasable from the bed frame using the locking mechanism and removable from the slot when the bed is in a lowered position with the wheelchair frame in contact with ground so as to allow a patient to travel in the wheelchair, the arm rest assembly movable with respect to the wheelchair frame, the arm rest assembly being in a lowered position with respect to the wheelchair seat when the bed frame is in the raised position and the wheelchair seat is generally aligned with the mattress, the arm rest assembly, when in the lowered position thereof, supported by the bed frame, the arm rest assembly being in a raised position with respect to the wheelchair seat before the wheelchair frame is released from the bed frame, the arm rest supporting mechanism engaging a portion of the arm rest assembly to maintain the arm rest assembly in the raised position before the wheelchair is removed from the slot.

2. A wheelchair and bed combination comprising bed assembly: and a wheel chair, the bed assembly comprising a bed frame, a mattress, the mattress and bed frame including a slot therein, and means for moving the bed at least up and down and between at least a raised position and a lowered position;

the wheelchair comprising a wheelchair frame, wheels, an arm rest assembly having a back portion and two side portions, a wheel chair seat, and an arm rest supporting mechanism, the wheelchair frame removably attachable to the bed frame, wherein the wheelchair frame is attached to the bed frame using a first locking mechanism when the bed frame is in a raised position with the wheelchair seat generally aligned with the mattress to form a bed surface for a patient lying on the bed, and releasable from the bed frame using the locking mechanism and removable from the slot when the bed is in a lowered position with the wheelchair frame in contact with ground so as to allow a patient to travel in the wheelchair, the arm rest assembly movable with respect to the wheelchair frame, the arm rest assembly being in a lowered position with respect to the wheelchair seat when the bed frame is in the raised position and the wheelchair seat is generally aligned with the mattress, the arm rest assembly supported by the bed frame when in the lowered position, the arm rest assembly being in a raised position with respect to the wheelchair seat with the wheelchair frame released from the bed frame using the first locking mechanism, the arm rest supporting mechanism engaging a portion of the arm rest assembly to maintain the arm rest assembly in the raised position for use by a patient when the wheelchair is removed from the slot, and further comprising an additional locking mechanism, the additional locking mechanism part of the arm rest supporting mechanism, wherein when the arm rest supporting mechanism is engaged with the arm rest assembly to maintain the arm rest assembly in the raised position, the additional locking mechanism is disengaged from the wheelchair frame to allow the wheelchair to be removed from the slot.

3. The wheelchair and bed combination of claim 1, wherein the arm rest assembly further comprises a back extension movably attached to the arm rest assembly, the back extension movable between a stored position when the wheelchair is in the slot and a raised position when the wheelchair is removed from the slot.

4. The wheelchair and bed combination of claim 1, wherein the arm rest assembly further comprises a pair of movable arm rests, each movable arm rest movable between a stored position when the wheelchair is in the slot and a raised position when the wheelchair is removed from the slot.

5. The wheelchair and bed combination of claim 1, wherein the first locking mechanism uses movable hooks on the bed frame to removably attach the wheelchair frame to the bed frame.

6. A wheelchair for use with a hospital bed having a slot and locking mechanism to attach the wheelchair to a bed frame of the hospital bed when the wheelchair is in the slot of the hospital bed, the wheelchair comprising a wheelchair frame, wheels, an arm rest assembly having a back portion and two side portions, a wheel chair seat, and an arm rest supporting mechanism, the wheelchair frame removably attachable to the bed frame, wherein the wheelchair frame is attached to the bed frame using a first locking mechanism when the bed frame is in a raised position with the wheelchair seat generally aligned with the mattress to form a bed surface for a patient lying on the bed, and releasable from the bed frame using the locking mechanism and removable from the slot when the bed is in a lowered position with the wheelchair frame in contact with ground so as to allow a patient to travel in the wheelchair, the arm rest assembly movable with respect to the wheelchair frame, the arm rest assembly being in a lowered position with respect to the wheelchair seat when the bed frame is in the raised position and the wheelchair seat is generally aligned with the mattress, the arm rest assembly when in the lowered position thereof, supported by the bed frame, the arm rest assembly being in a raised position with respect to the wheelchair seat before the wheelchair frame is released from the bed frame, the arm rest supporting mechanism engaging a portion of the arm rest assembly to maintain the arm rest assembly in the raised position before the wheelchair is removed from the slot.

7. The wheelchair of claim 6, further comprising an additional locking mechanism, the additional locking mechanism part of the arm rest supporting mechanism, wherein when the arm rest supporting mechanism is engaged with the arm rest assembly to maintain the arm rest assembly in the raised position, the second locking mechanism is disengaged from the wheelchair frame to allow the wheelchair to be removed from the slot.

8. The wheelchair of claim 6, wherein the arm rest assembly further comprises a back extension movably attached to the arm rest assembly, the back extension movable between a stored position when the wheelchair is in the slot and a raised position when the wheelchair is removed from the slot.

9. The wheelchair of claim 6, wherein the arm rest assembly further comprises a pair of movable arm rests, each movable arm rest movable between a stored position when the wheelchair is in the slot and a raised position when the wheelchair is removed from the slot.

10. The wheelchair of claim 6, wherein the first locking mechanism uses movable hooks on the bed frame to removably attach the wheelchair frame to the bed frame.

11. A method of moving a patient in a bed to a wheelchair that is part of the bed comprising:

a) providing the wheelchair and bed combination of claim 1 with the bed frame in a raised position and the wheelchair attached to the bed frame;

b) lowering the bed frame to place the wheelchair on ground;

c) detaching at least a portion of the wheelchair frame from the bed frame;

d) raising the bed frame so as to raise the arm rest assembly of the wheelchair to form a space of the wheelchair;

e) securing the arm rest assembly in a raised position to the wheelchair; and f) removing the wheelchair from the slot in the bed frame to allow the wheelchair to be moved.

12. The method of claim 11, wherein the steps (b-f) are reversed to make the wheelchair seat part of the bed.

* * * * *